US007121953B2

(12) United States Patent
Simpson

(10) Patent No.: US 7,121,953 B2
(45) Date of Patent: Oct. 17, 2006

(54) PRACTICE GOLF CLUB, TARGET, AND SWING PLATFORM APPARATUS

(76) Inventor: Timothy A. Simpson, 1574 Sugar Maple Way, West Bloomfield, MI (US) 48324

( * ) Notice: Subject to any disclaimer, the term of this patent is extended or adjusted under 35 U.S.C. 154(b) by 59 days.

(21) Appl. No.: 11/047,950

(22) Filed: Jan. 31, 2005

(65) Prior Publication Data

US 2005/0192113 A1 Sep. 1, 2005

Related U.S. Application Data

(63) Continuation-in-part of application No. 10/356,810, filed on Feb. 3, 2003, now Pat. No. 6,849,001.

(60) Provisional application No. 60/608,443, filed on Sep. 9, 2004, provisional application No. 60/442,488, filed on Jan. 25, 2003.

(51) Int. Cl.
*A63B 69/36* (2006.01)

(52) U.S. Cl. ..... 473/226; 473/235; 473/236; 473/231

(58) Field of Classification Search ..... 473/219–262, 473/390–392, 290, 278–279, 162
See application file for complete search history.

(56) References Cited

U.S. PATENT DOCUMENTS 4,875,685 A * 10/1989 Ballinger et al. ..... 473/262
6,450,895 B1 * 9/2002 Galluzzo, Jr. ..... 473/279
6,849,001 B1 * 2/2005 Simpson ..... 473/226

* cited by examiner

*Primary Examiner*—Sebastiano Passaniti
(74) *Attorney, Agent, or Firm*—Ernest E. Helms

(57) ABSTRACT

A golf practicing apparatus is provided which includes a club with a latch member. A target is provided which is held by a mount. When the golf club is swung in a predetermined manner, the target is released from the mount and is connected with the golf club. When the golf club is swung in an improper manner the target pivots downward and is retained by the mount.

19 Claims, 44 Drawing Sheets

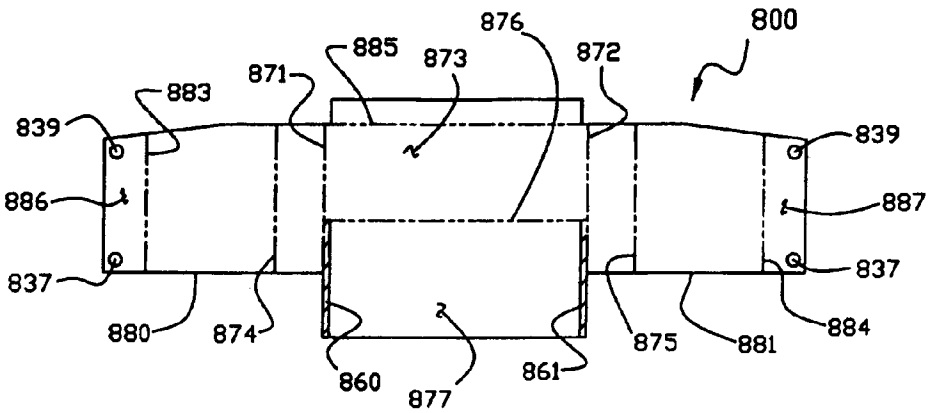
Fig. 45
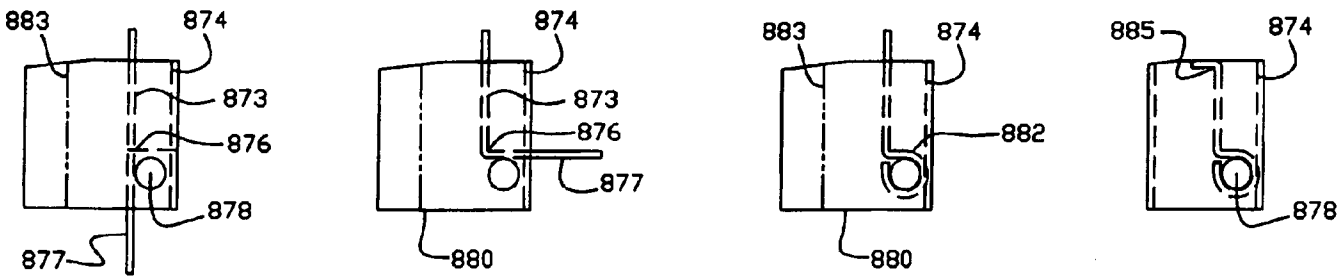
Fig. 45A
Fig. 45B
Fig. 45C
Fig. 45D

PRACTICE GOLF CLUB, TARGET, AND SWING PLATFORM APPARATUS

This application claims the benefit of U.S. Provisional Application 60/442,488 entitled Golf Club Hook And Base Target Support Apparatus, filed Jan. 25, 2003 under U.S. Express Mail Label # EU762494000 US; this application claims the benefit of U.S. Provisional Application 60/608,443 Entitled Golf Hook And Target Support Receptacle And Adjustable Swing Platform Apparatus, filed Sep. 9, 2004 under U.S. Express Mail Label # ED305824395US; and this application is a Continuation in Part of U.S. Pat. No. 6,849,001 entitled Practice Golf Club And Target Apparatus application Ser. No. 10/356,810 filed Feb. 3, 2003.

FIELD OF THE INVENTION

The field of the present invention is apparatuses for practicing golf and, more particularly, the present invention relates to an apparatus utilized to reinforce the fundamentals of the swing of a wood or iron golf club.

BACKGROUND OF THE INVENTION

To develop a consistent golf swing many fundamentals must be learned some of which include the following. The golf club must be swung along a correct swing plane that is an imaginary circular path that is parallel to the target line. The target line is a line from the golf ball to the flag or desired target point. The golf club must strike the ball with the leading edge of the clubface perpendicular to, or at a ninety-degree angle to the target line. Accordingly, it is desirable to provide an apparatus that reinforces the aforementioned fundamentals by which a golfer can use to practice developing a consistent golf swing. Additionally, during inclement weather or seasonal weather conditions, it is desirable to provide an apparatus with which one can practice golf swing fundamentals year round in an indoor setting.

SUMMARY OF THE INVENTION

The invention as presented in the present application is best described in the Detailed Description of the Inventions which is presented in FIG. 43 and beyond. The present invention provides an apparatus for use to develop a consistent fundamentally correct swing of golf clubs particularly irons and woods. In a preferred embodiment, the present invention provides a latch member, which is connected with the golf club. A target is held within a mount mechanism positioned on a platform or the floor. A fundamentally correct golf swing is predetermined to be correctly executed when a golf club is swung on the correct swing plane (that is along a circular path having a diameter that is parallel to a target line), and the center of the golf club head face just above the leading edge of the golf club head is square to the target line at the point of impact with a golf ball. If the aforementioned conditions are met, a latch member will pull a target away from a mount and the target will be retained on the club. The recoil of the golf club at the instant the target is released will alert the golfer that the club was swung properly. If the club is swung improperly, the latch member hits the target and the target will simply pivot downward while being retained by the target-mount mechanism.

BRIEF DESCRIPTION OF THE DRAWINGS

FIGS. 45, 45 A, 45 B, 45 C, and 45 D, are schematic views illustrating forming fabrication of a frame golf a pivot arm assembly.

FIG. 49 is a perspective view of the combination swing platform shown in FIG. 49D.

FIG. 54 A is a top plan schematic view of the hook portion of the latch member and expert tab approaching a target when the golf club is swung in a manner which is off from an expert level of squareness.

DETAILED DESCRIPTION OF THE INVENTION

Figure 1:
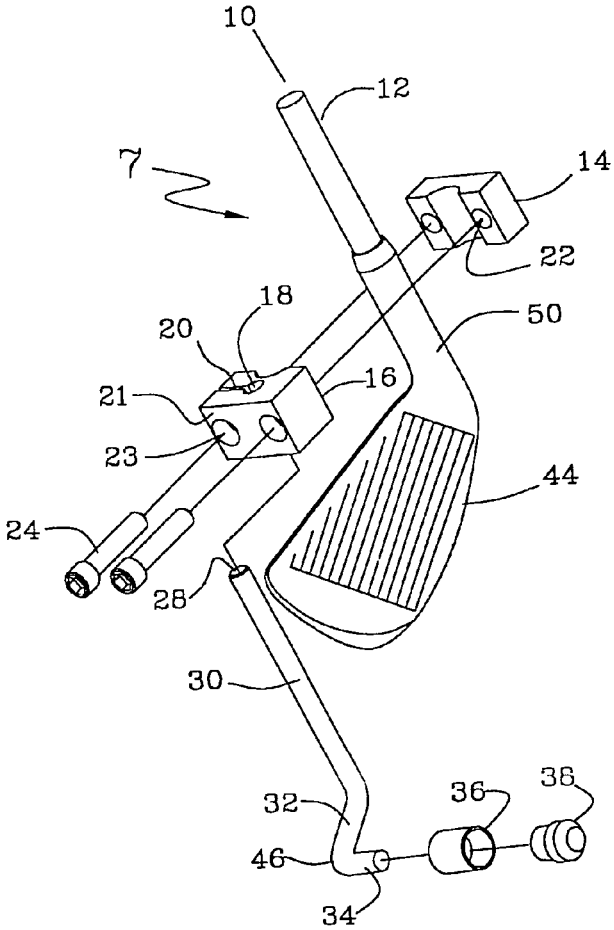
FIG. 1 is an exploded view of the lower portion of a golf club, notably an iron, showing the latch member and the mechanism allowing for an adjustment and attachment of said latch member on said golf club.
Figure 2:
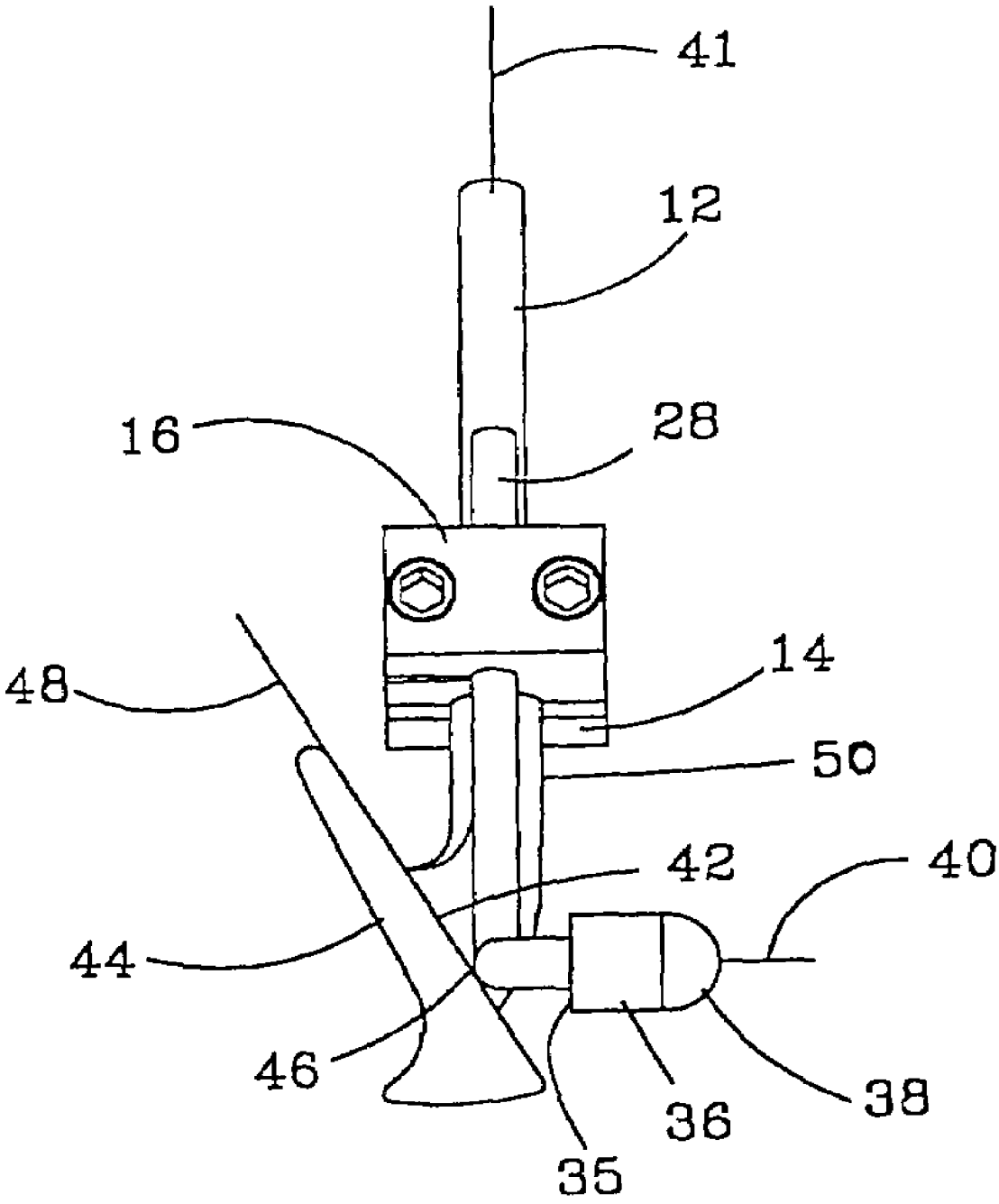
FIG. 2 is a view of the golf club shown in FIG. 1 with the latch member being properly adjusted upon the golf club.
Figure 3:
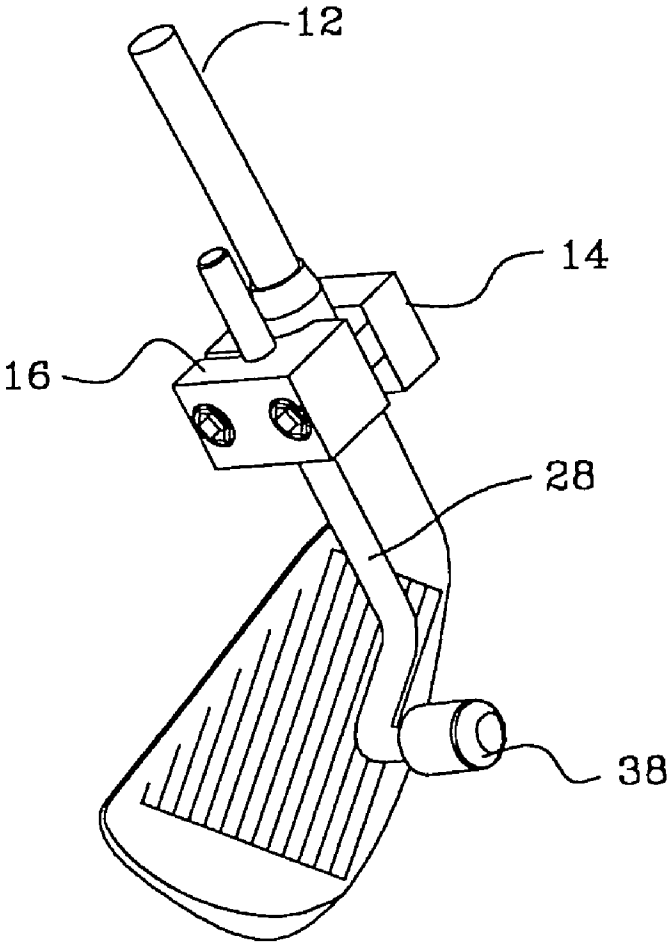
FIG. 3 is a perspective view of FIG. 2 illustrating the golf club and the attached latch member.

Referring to FIGS. 1–3, the present inventive golf ball hitting simulation apparatus 7 includes a golf club 10 having a shaft 12. An extreme lower end 50 of the shaft, sometimes referred to as the hosel or neck, has clamped thereto clamping members 14 and 16. The clamping member 16 has a vertical bore 18 through a top and bottom side. The clamping member 16 has a slot 20 that is parallel with a front side 21. The bore 18 is perpendicular with and located midway between bores 23. The clamping member 14 has a pair of bores 22 with centers coaxial with the centers of bores 23. Typically the bores 22 of the clamping member 14 will be threaded to receive threaded fasteners provided by set screws 24. Bores 23 of clamping member 16 typically will not be threaded. Clamping members 16 and 14 have a semi-bore 33 and 31 of which the centerline is midway between bores 23 and 22 and coincides with a line extending from an edge 19 and 25 of the clamping members. The hosel 50 of the golf club is captured by the semi-bores 23 and 31 as the clamping member 16, 14 are adjustably connected with screws 24.

Positioned within the bore 18 is a latch member provided by a hook shaft 28. The hook shaft 28 has an elongated portion 30, an angled portion 32 and a forward projecting portion 34. The angle portion 32 and forward projecting portion 34 are perpendicular to one another. The forward projecting portion has connected thereon a polymeric (typically plastic) sleeve 36. Connected within the sleeve 36 is an elastomeric impact head 38. The bore 18 and slot 20 allow the hook shaft 28 to be connected to clamping member 14 and the club 10 by tightening the set screws 24. Additionally, the set screws 24 can be loosened so that the hook shaft 28 can be adjusted up and down through the bore 18 or be twisted within the bore 18 as adjustments about a face 42 of a golf club head 44 are required.

The impact head 38 projects forward along a line 40 that is coincident with the projecting portion 34 (FIG. 2). With respect to the golf club leading edge, placed at a ninety-degree angle to the target line, the hook shaft 28 is properly positioned upon the face 42 of the golf club head 44 when the portion 32 of the shaft is contacting the club face 42 and the line 40 is parallel with the target line (ground or floor). In other words the portion 32 should be parallel with while the projecting portion 34 should be perpendicular to a longitudinal axis of the club face 42. Additionally, the projecting portion 34 should form an angle with a transverse axis of the club face 42 equal to its loft angle (the angle between line 41 and a line 48) plus ninety degrees (the fixed angle between line 41 and line 40).

The clamping members 14, 16 and hook shaft 28 can be placed on golf clubs having different loft angles. Because considering line 41 a datum, line 40 is fixed ninety degrees clockwise with respect to line 41 while the loft angle varies counter clockwise relative to line 41. Therefore, the latch member can be adjusted for use on a club having a different loft angle by rotation of the hook shaft 28 within the bore 18, by sliding the hook shaft 28 up or down within the bore 18 or by positioning the clamping members 14 and 16 about the hosel 50 of the golf club.

Figure 1A:
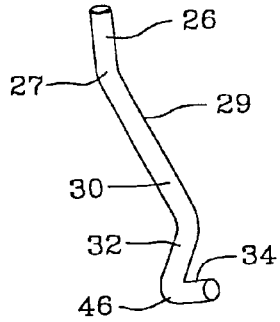
FIG. 1A is a perspective view of an alternate preferred embodiment latch member to that shown in FIG. 1.
Figure 4:
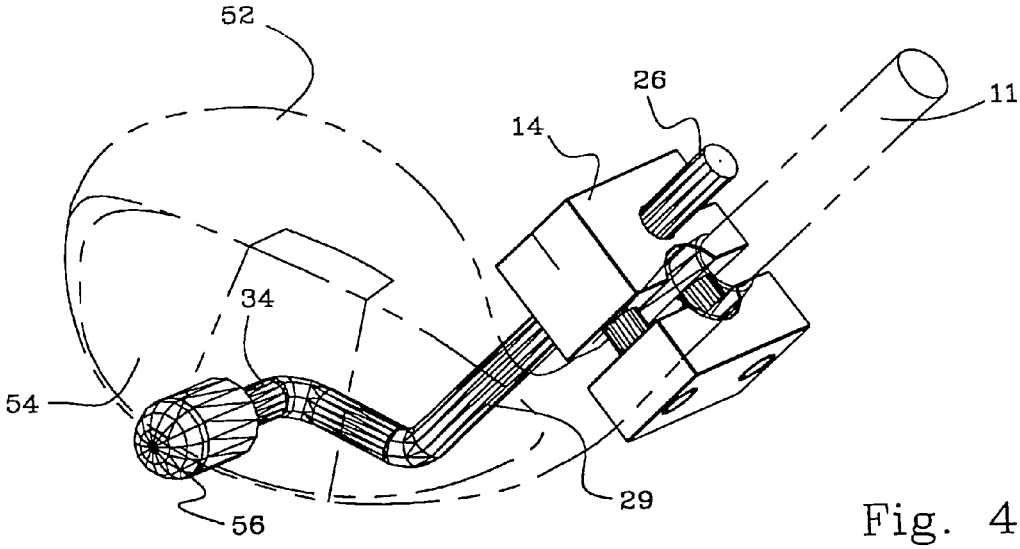
FIG. 4 is a perspective view of the golf ball hitting simulation apparatus of the present invention utilized with a driver.

Referring to FIGS. 1A and 4, with similar items being given like reference numerals, a hook shaft 29 is shown connected to a wood golf club head 52. The hook shaft 29 has a straight upper portion 26, which is joined to the elongated portion 30 at an angled bend 27. The wood club head 52 has a face 54, which is offset forward from the club shaft 1. The upper portion 26 and the angled bend 27 allow the hook shaft 29 to be adjusted to accommodate the offset of the club face 54. Again, the clamping member 14 allows the hook shaft 29 to be adjusted into the proper position such that the forward projecting portion 34 of the hook shaft is oriented perpendicular to a longitudinal axis of the face 54 and projects along a line parallel with the target line. An impact head 56 is impregnated with a marking material, such as ink, or is made of a marking material so that the impact head 56 will leave a mark on a target upon contact. The mark will alert the practitioner of their swing path relative to the target line indicating the golf club was swung on an incorrect swing plane or was swung in a non-predetermined manner.

Figure 5:
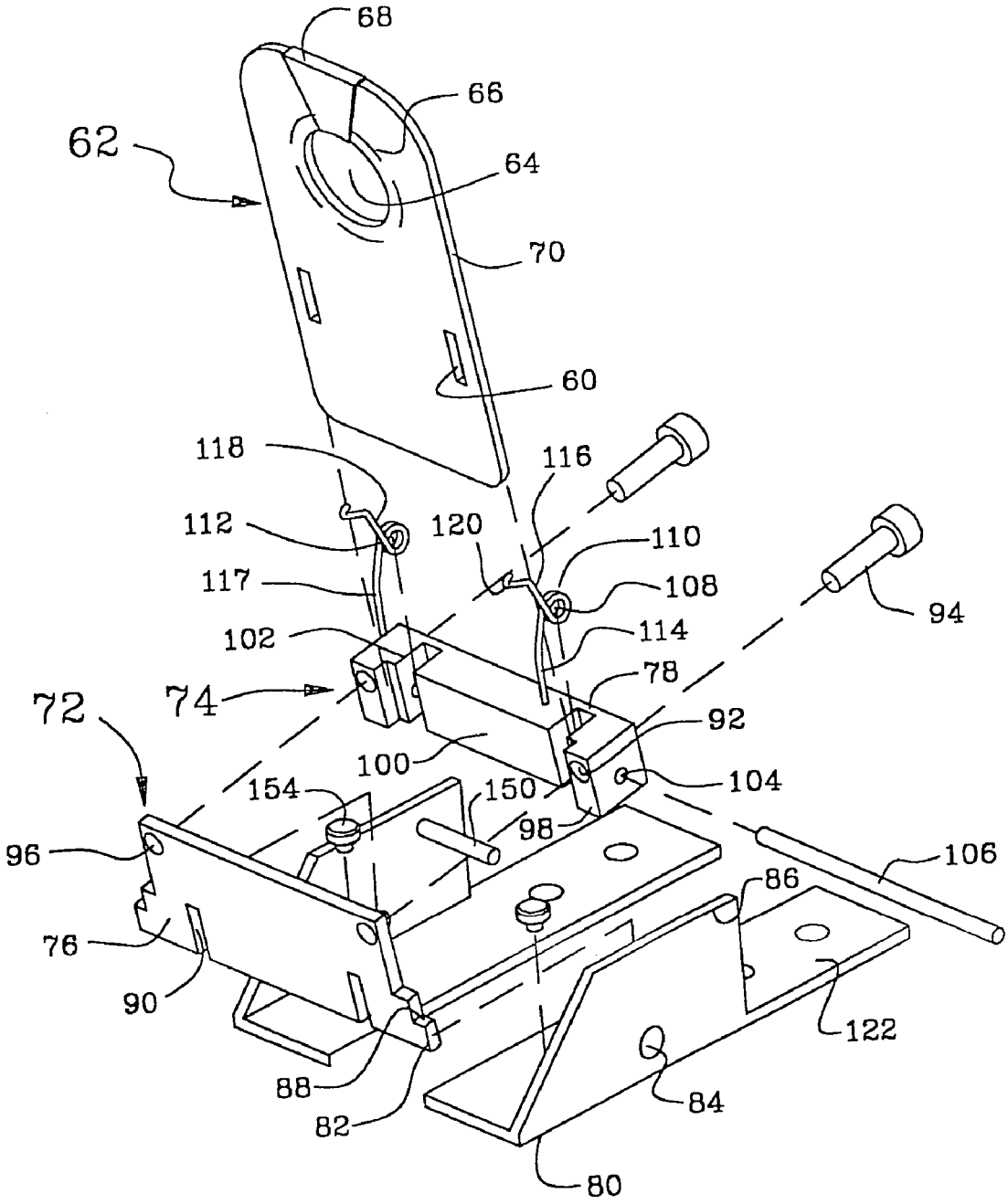
FIG. 5 is an exploded view of the mount and target of the present invention.

Referring additionally to FIG. 5, the golf ball hitting simulation apparatus 7 of the present invention additionally includes a target 62. The target 62 is a planar member which is typically fabricated from a nylon, plastic or other suitable materials. The target has a first aperture 64 for receipt of forward projecting portion 34 of the hook shaft when the golf club 10 is swung in the predetermined proper manner. The target 62 has two lower holding apertures 60. The aperture 64 of the target can be enlarged to a diameter 66 for a beginner golfer and can be reduced for a more skilled practitioner. The target 62 also has a reinforcement portion 68 to discourage the propagation of cracks. As shown, the target has a main body portion 70 which is approximately 2.5 mm in thickness. However, the target can be made thicker or thinner as deemed appropriate.

Referring additionally to FIGS. 6, 7 and 9–19, to position the target 62 for striking by the golf club there is provided a mount 72. The mount 72 has a pivot arm 74. The pivot arm 74 includes a front plate 76 and a rear plate 78. Mount 72 is also provided with a base 80. The front plate 76 has two oppositely extending pins or side arms 82. The side arms 82 are pivotally captured within bearing apertures 84 provided in the base side wall 86. The side arms 82 have generally rounded top and bottom sides 88. The front plate 76 has two generally vertical slots 90 which intersect a lower end of the front plate.

The rear plate 78 has two bores 92. The bores 92 accept the shanks of set screws 94. The set screws 94 pass through the bores 92 and then penetrate into bores 96 of the front plate 76. Typically, the bores 96 will be threaded or a threaded nut (not shown) will connect with the set screws 94 to allow for the connection of the front plate 76 with the rear plate 78. The rear plate 78 has a forward abutting face 98 which abuts against the front plate 76. The rear plate is also provided with a longitudinal slot 100. The slot 100 provides a gap between the portion of the rear plate 78 and front plate 76 for receipt of the target 62. The rear plate 78 also has two parallel spaced generally transverse spring slots 102. Intersecting the spring slots 102 is a hole or bore 104. The bore 104 receives a pin 106. The pin 106 passes through openings 108 of springs 110, 112 to mount the springs 110, 112 within the spring slots 102. Springs 110, 112 are coil springs. The spring 110 has a lower leg 114 which is inboard of its upper leg 116. The spring 112 has a lower leg 117 which is inboard of its upper leg 118. Both upper legs 116, 118 have an elbow 120.

The side walls 86 are generally joined with a floor plate 122. The floor plate 122 is joined by a bolt 124 and nut 126 combination to a lower portion 128 of a swing platform 130. The floor plate 122 can be two separate members or can be stamped with a single piece of metal 139 (FIG. 18) having a portion joining the two floor plates together.

Figure 13:
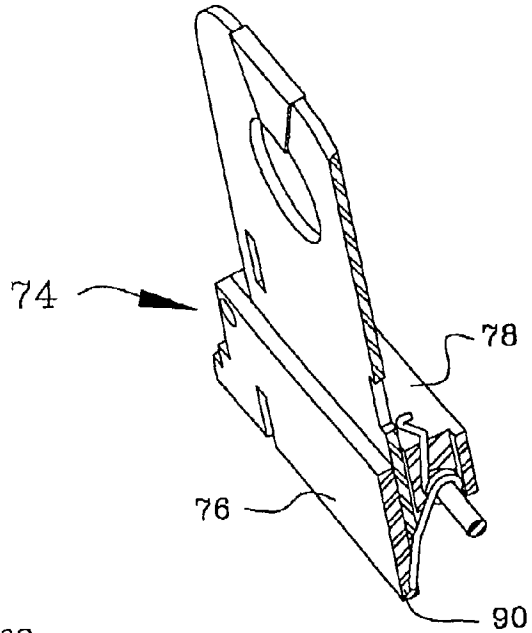
FIGS. 12, 13 and 14 are perspective views partially sectioned illustrating installation of the target to a pivot arm of the present invention.
Figure 14:
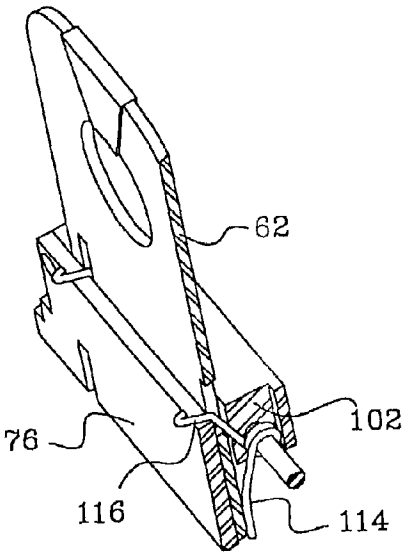
Figure 12:
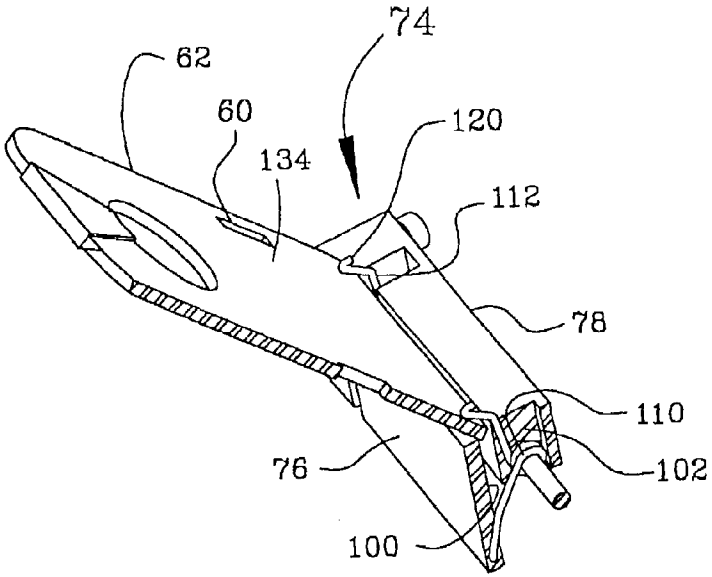
Figure 15:
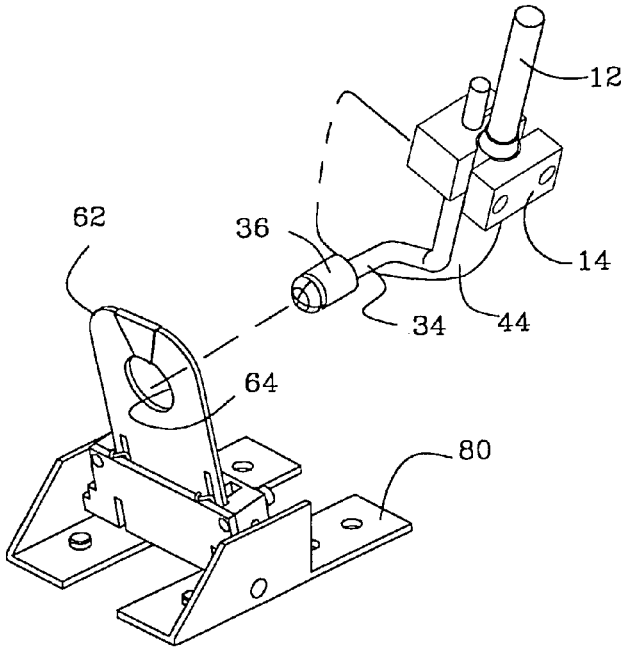
FIGS. 15, 16 and 17 are operational views illustrating the connection of the target with the latch member when the golf club of the present invention is swung in a predetermined manner.
Figure 16:
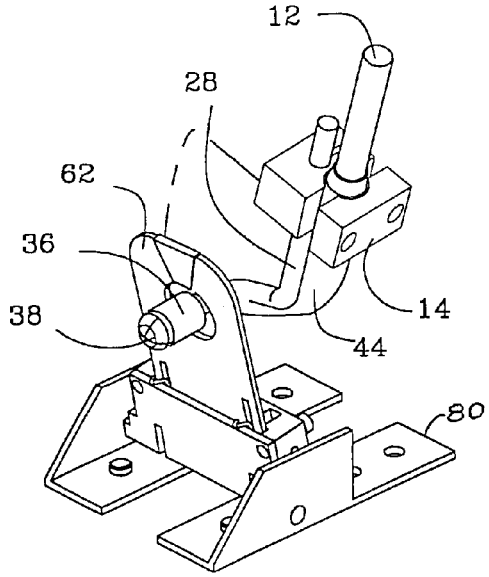
Figure 17:
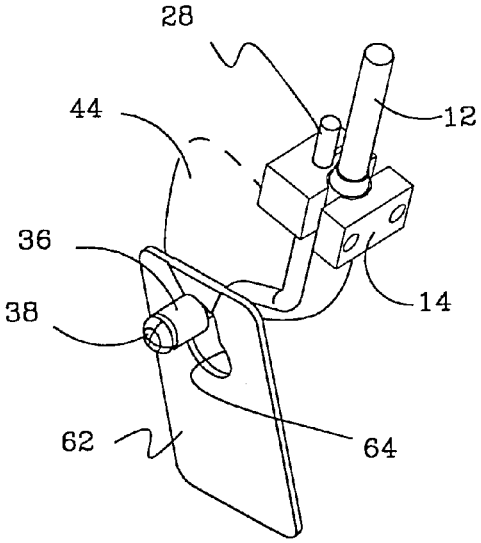

Referring in particular to FIGS. 12–14, for clarity of illustration the pivot arm 74 is shown assembled together with one side of the rear plate 78 being sectioned about the spring slot 102. In a similar manner, the front plate 76 is shown sectioned about slot 90. The target has its lower end aligned with the target slot 100 as best shown in FIG. 13. A bottom end on target 62 is brought under the elbows 120 of the springs 110, 112. The target is pivoted (FIG. 12) to a more vertically upward aligned position causing the elbows 120 of the springs to ride up on a rear surface 134 of the target. As the target is further pushed down into slot 100 the elbows will finally come to a point wherein they will enter into the holding aperture 60 of the target. The target 62 now has snap-fit engagement with the springs 110, 112 to provide for latched retention. The target 62 will have further engagement with the springs 110, 112 by virtue of engagement with the lower legs 114, 117. The engagement of the target with the lower legs 114, 117 causes the springs 110, 112 to be torsionally loaded about their coiled portion. Therefore, the target 62 is also compliantly retained.

The target 62 is now connected with the mount. Referring to FIGS. 6, 7, 9 and 10, a partial view of a target and mount 72 is shown. The target in the striking position, is inclined slightly forward by angle 140 from the vertical. Angle 140 will typically be in the range of 20–0 degrees and preferably will be approximately 10 degrees. The pivot arm 74 and the target 62 have a center of gravity 142 which is slightly over center to a vertical line 144. The pivot arm as mentioned previously pivots about the side arms 82. A stop pin 150 which projects from one of the side walls 86 prevents the pivot arm from pivoting rearwardly.

A fundamentally correct golf swing is predetermined to be correctly executed when a golf club is swung on the correct swing plane (that is along a circular path having a diameter that is parallel to a target line and the center of the club head face just above the leading edge of said club head is square to the target line at the point of impact with a golf ball. Referring additionally in particular to FIGS. 11, 15, 16 and 17, when the golf ball hitting simulation apparatus 7 of the present invention is used by a practitioner who swings the golf club in the predetermined manner, the impact head 38 will enter into the aperture 64. As the sleeve 36 of the hook shaft 28 passes through the aperture 64, the upper part of the aperture will then be captured onto the forward projecting portion 34 of the hook shaft. The continuing upward swing best shown in FIG. 12 will pull the target 62 upward causing the spring elbows 120 to be pulled out of the retention apertures 60, to thereby release the target 62 from the mount. The target 62 will now be connected with the hook shaft 28 and the practitioner will have visual confirmation that his/her swing was proper.

Figure 8:
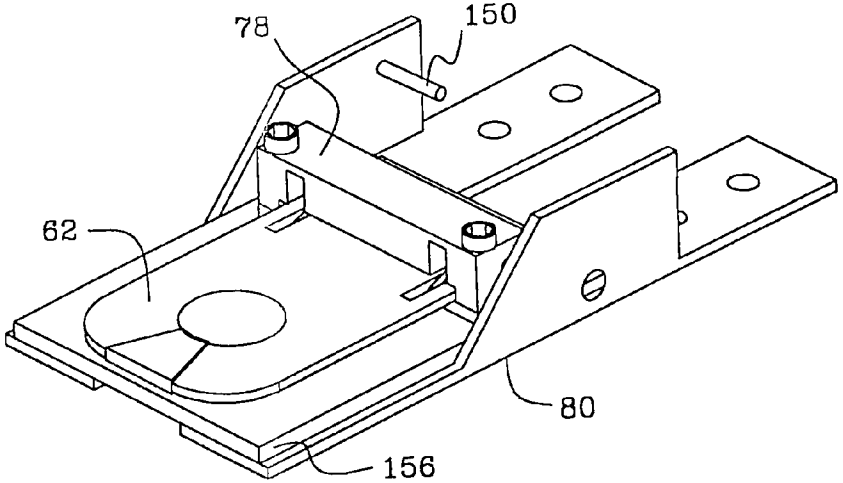
FIG. 8 is a perspective view similar to that of FIG. 7 of an alternate preferred embodiment of the present invention which has a membrane bumper to provide dampening when the target has been pivoted forward.
Figure 6:
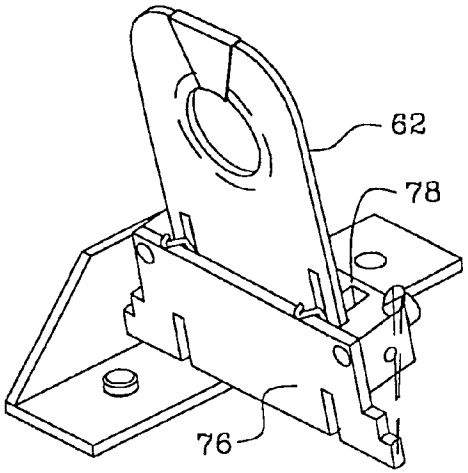
FIG. 6 is a partial perspective view of the mount illustrating the target installed in its upright position.
Figure 7:
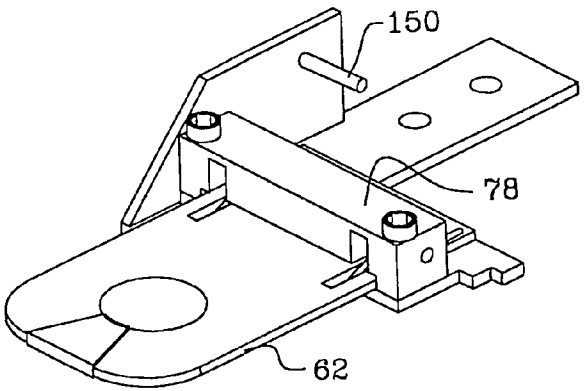
FIG. 7 is a view similar to FIG. 6 illustrating the target in its forward downward pivoted position which is assumed when the target has been hit in a non predetermined manner.
Figure 9:
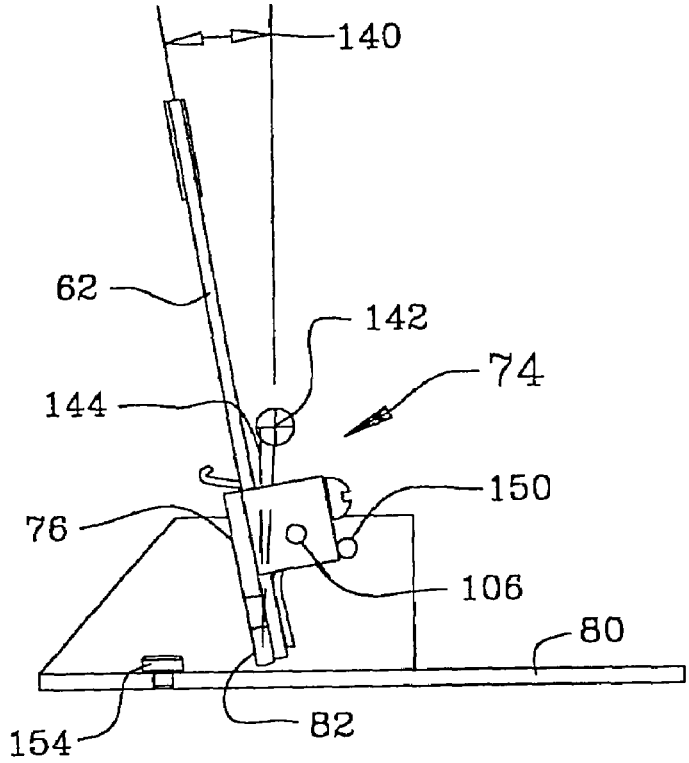
FIGS. 9 and 10 are partial side elevation views of the mount and target shown in positions corresponding to FIGS. 6 and 7 respectively.
Figure 10:
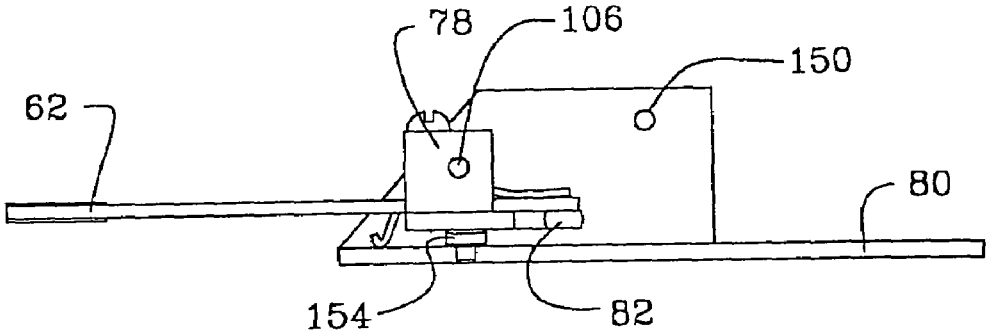
Figure 11:
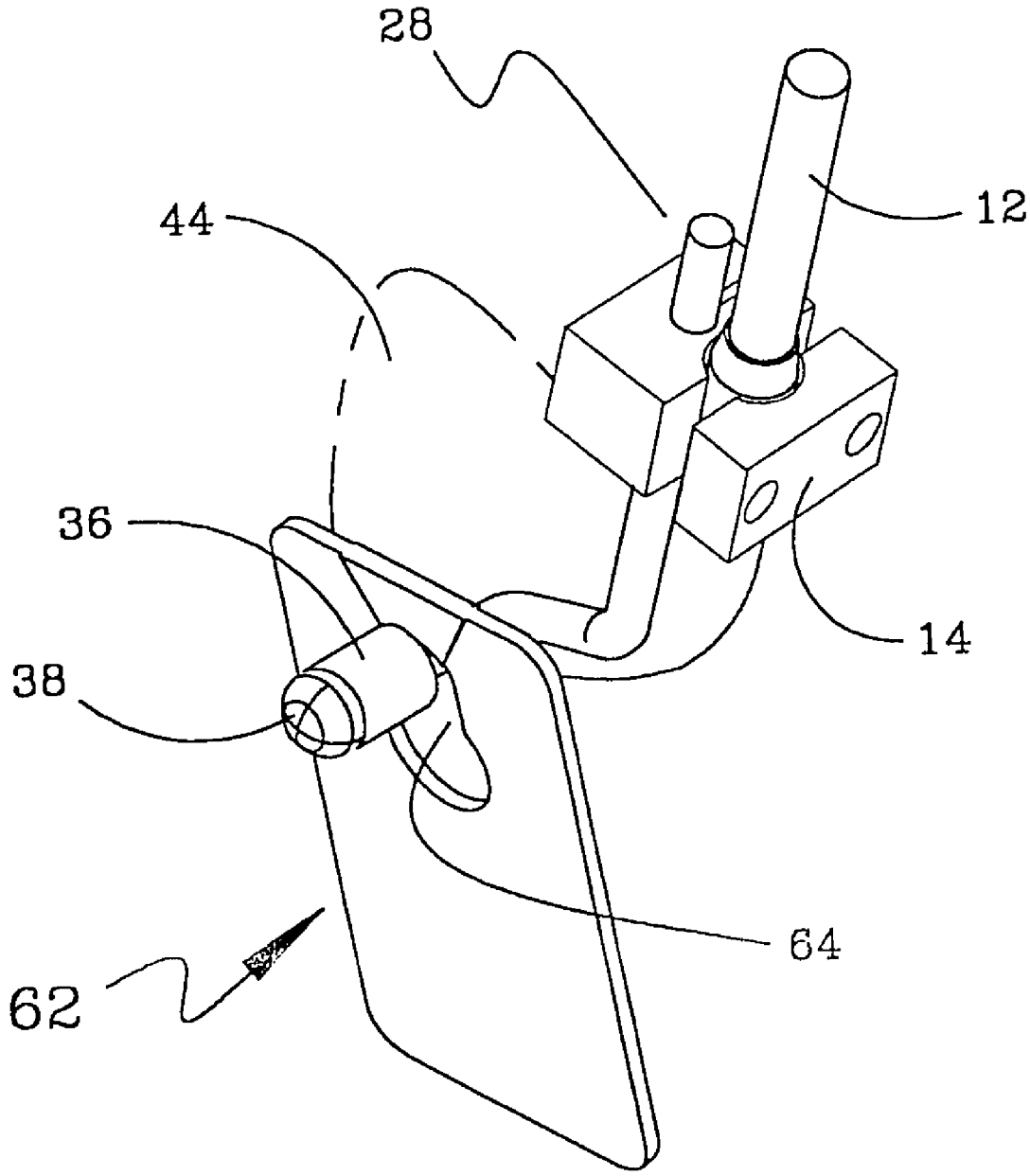
FIG. 11 is a perspective view of the golf club of the present invention having the target connected with the latch member.

If the practitioner has swung the golf club in a non-predetermined manner, the impact head will not enter the aperture 54 but instead will hit the target in which case, the pivot arm 74 will retain the target 62 and will pivot downward. To minimize a rebound or bounce back of the pivot arm, there is provided polymeric, preferably elastomeric, dampening pads 154 that are press fitted into circular holes (not shown) provided in the floor plates 122. In the embodiment shown in FIG. 8, a sheet 156 of polymeric or elastomeric material is supplied to provide the dampening function to minimize rebound of the target 62 and the pivot arm 74. The practitioner thereafter takes the target and pivot arm (FIG. 7) and pivots them to an upright position as shown in FIG. 6.

Figure 18:
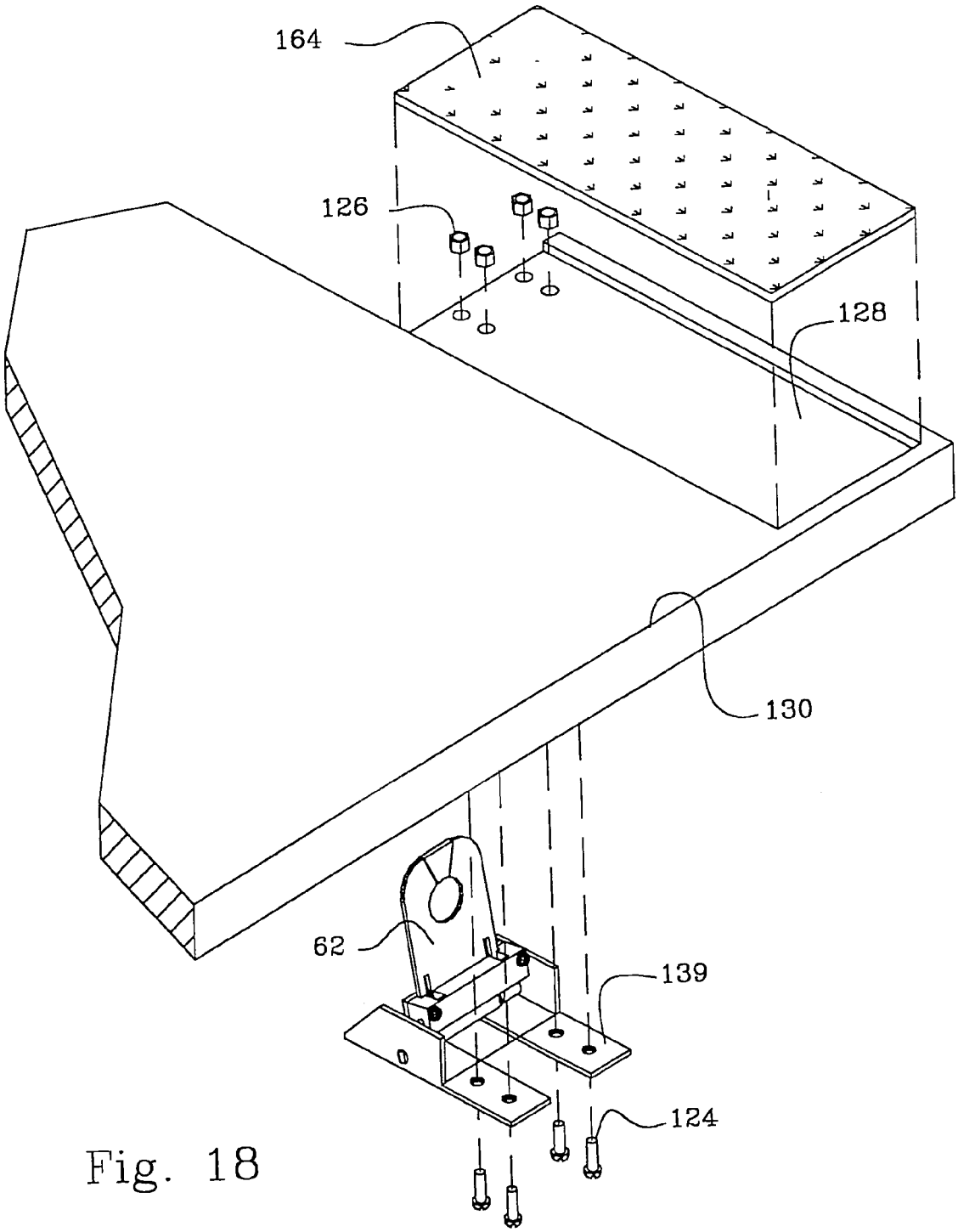
FIG. 18 is an exploded view of a portion of a platform of the present invention to which the mount is connected.
Figure 19:
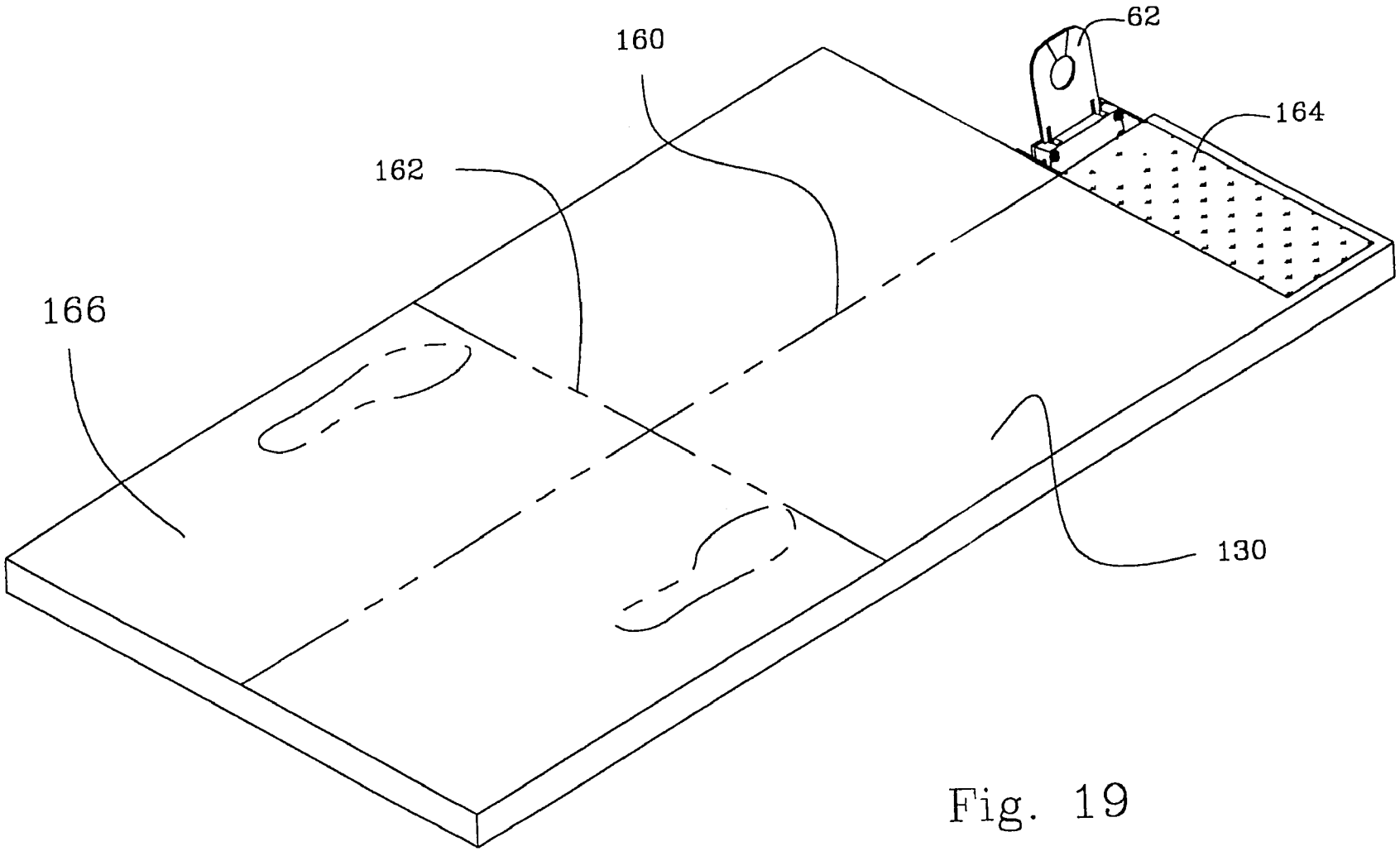
FIG. 19 is a perspective view of a swing platform utilized with the golf club of the present invention.

Referring to FIGS. 18 and 19, the swing platform 130 may optionally have cross lines 160, 162 to provide a practitioner with general alignment aids for positioning their feet relative to the target and the lower portion 128 can be covered with a turf appearance type carpeting cover 164. A top surface of the platform 166 will be slightly higher than an uppermost point of the pivot arm when said pivot arm is in an upright position and said platform top surface is measured relative to a pivotal axis of pivot arm 74.

Referring to FIGS. 20, 20A, and 21 through 29, an alternate preferred embodiment 207 of the present invention is provided. A formed base component 270 has a side face 272 and a side face 274 both of which bends rearward ninety degree to form corners with a front face 276. The front face 276 has a ninety-degree lengthwise top corner 280 from which an upper margin 278 projects rearward. The base component 270 has a horizontal bottom 282 that forms a ninety-degree lengthwise bottom corner 284 with the front face 276. The bottom 282 extends rearward a short distance before bending upward forming a ninety-degree angle with a lower rear face 286. The rear face 286 extends upward a short distance before bending rearward forming a ninety-degree corner from which a lower margin 288 extends rearward. The bottom 282 of the base component 270 is captured between side faces, 272 and 274.

Figure 20:
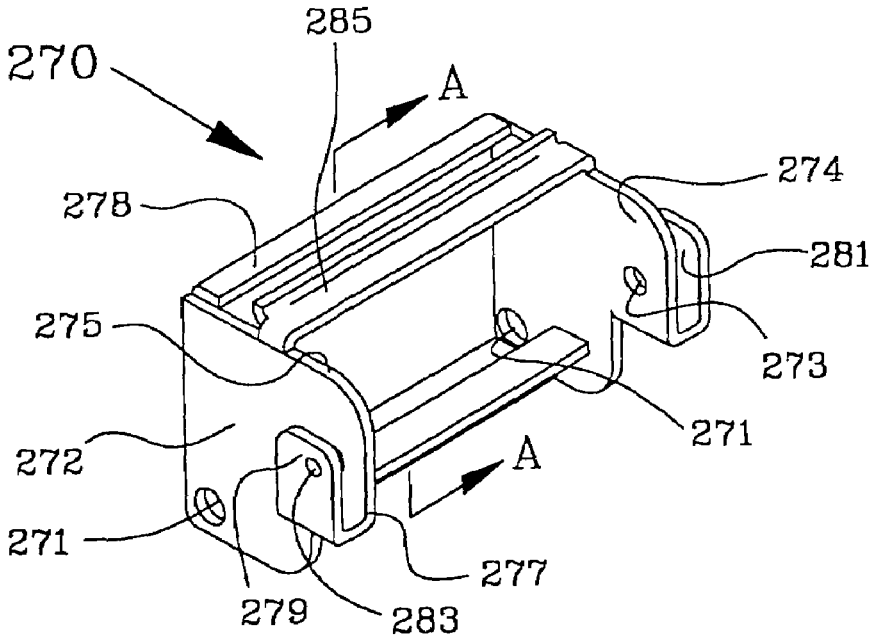
FIG. 20 is a perspective view of an alternate preferred embodiment base component of the mount of the present invention.
Figure 20A:
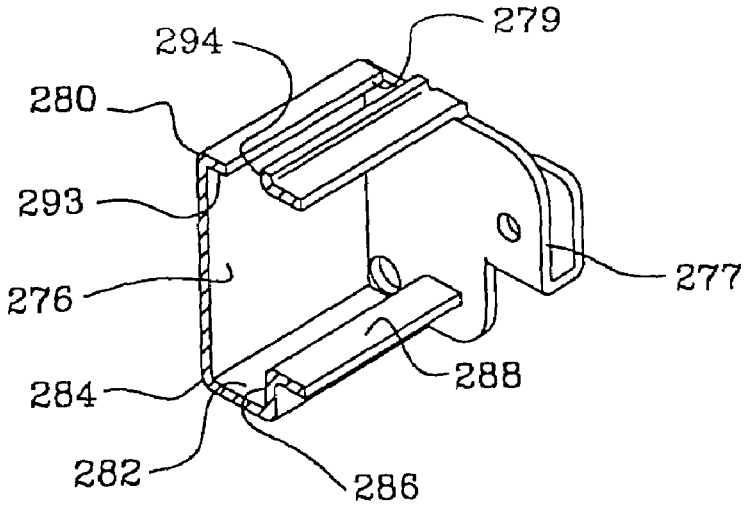
FIG. 20A is a partial perspective view of the mount base component illustrating target-bearing surfaces.
Figure 21:
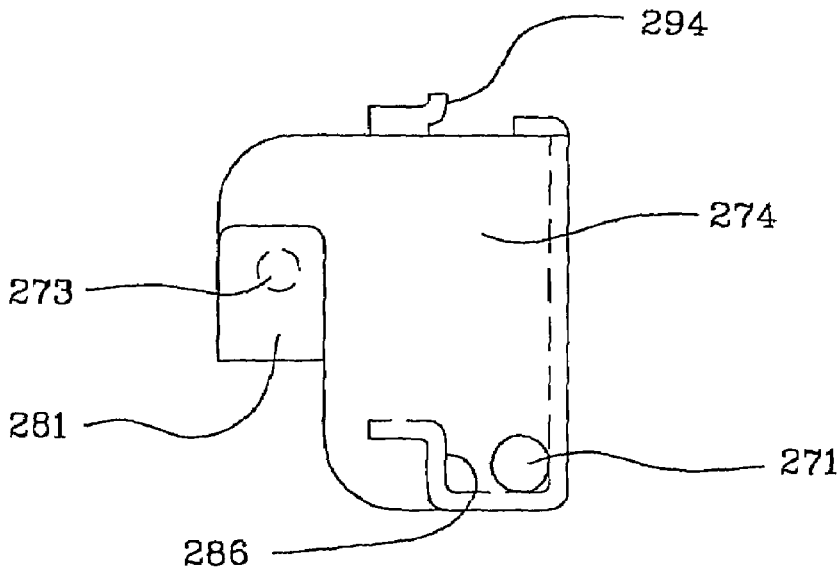
FIGS. 21 and 22 are right and left side perspective views of the present invention illustrating the relative location of holes in the base component of the target-mount mechanism for receiving and supporting the spring wire.

Referring to FIGS. 20 and 21, a channel member 285 having a bracket-shaped cross-section connect with a top edge 275 of side faces, 272 and 274. A side 294 of the channel member 285 extends upwards a short distance and is coplanar with the lower rear face 286 of the base component. In the present invention the base component 270 is formed out of 16-gage (0.062 inch thick) sheet metal. The side faces 272 and 274 each have a plurality of circular holes. A first pair of cylindrical holes 271 has coaxial centers, one on each side face located near the bottom corner 284. A second pair of cylindrical holes 273 has coaxial centers; one on each side face located near rear edges 277 and approximately one-third from the edge 275.

Figure 22:
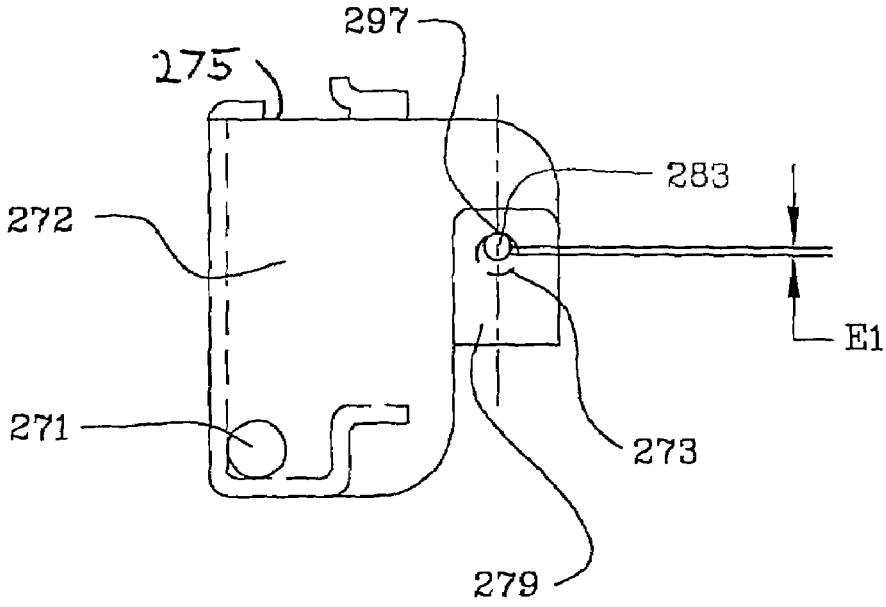

Referring to FIGS. 21 and 22, projecting tabs 279 and 281 are located lateral of holes 273 of side faces 272 and 274, respectively. Each tab projects perpendicularly outward before turning vertically upward. A right perspective view of the base component (FIG. 21) shows the height of projecting tab 281 is sufficient to block off access to hole 273 of side face 274. A left perspective view (FIG. 22) shows the projecting tab 279 to be similar to projecting tab 281 with the exception of a circular hole 283. The hole 283 and hole 273 of side face 272 have centers that are eccentric when projected along a common vertical axis (as referenced by dimension E1 in FIG. 22). Additionally, the projection of hole 283 and hole 273 onto said common vertical axis show that their vertices coincide at a point 297 (FIG. 22). The diameter of hole 283 is typically smaller than the diameter of holes 273.

Figure 23:
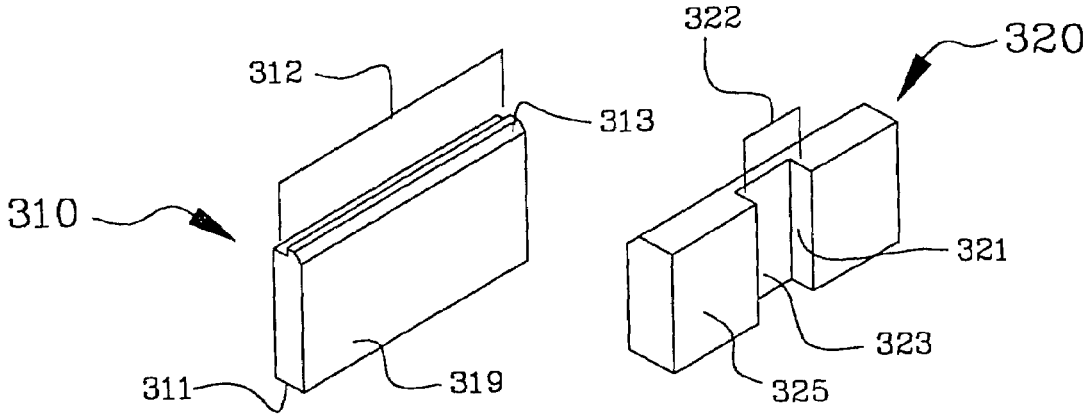
FIGS. 23 and 24 are front and rear perspective views illustrating the clamp plate and the friction pad of the present invention.
Figure 24:
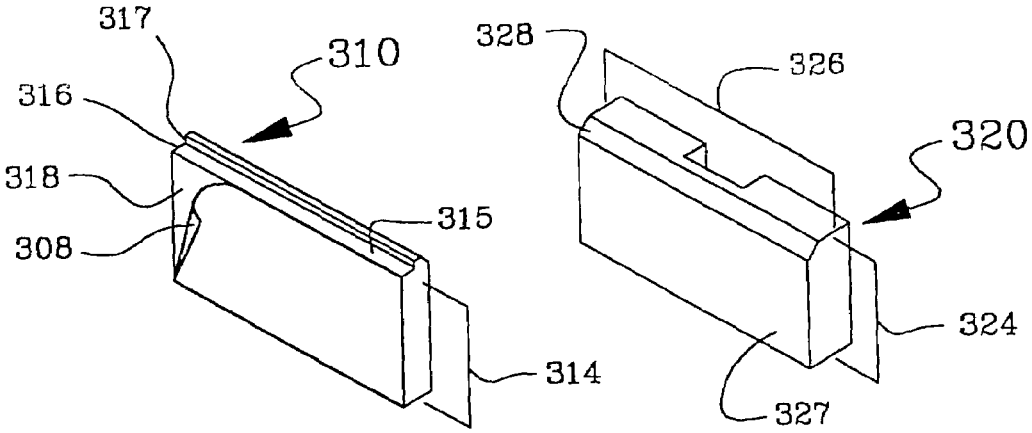

Referring to FIGS. 23 and 24, a removable clamp plate 320 has a height 324 slightly less than the vertical dimension between the bottom side of the channel member 285 and the lower margin 288. A length 326 of the clamp plate is slightly less than the inside dimension between the side faces 272 and 274. The clamp plate 320 has a front face 327 that has a lengthwise beveled top edge 328. The clamp plate has a vertical slot 322 located at the midsection of a rear face 325 and perpendicular to its longitudinal axis. The depth of the slot is determined such that the rigidity of the clamp plate is not compromised. In the present invention the slot 322 has parallel sides 321 spaced 12.7 mm apart and a bottom 323 having a depth of about 3.8 mm, or half the 7.6 mm plate thickness. The height and length 324, 326 dimensions allow the clamp plate to float within an opening defined by the channel member 285, side faces 372 and 374, and the lower margin 288. In the preferred embodiment of the present invention the clamp plate is made of a polymeric material.

Figure 25:
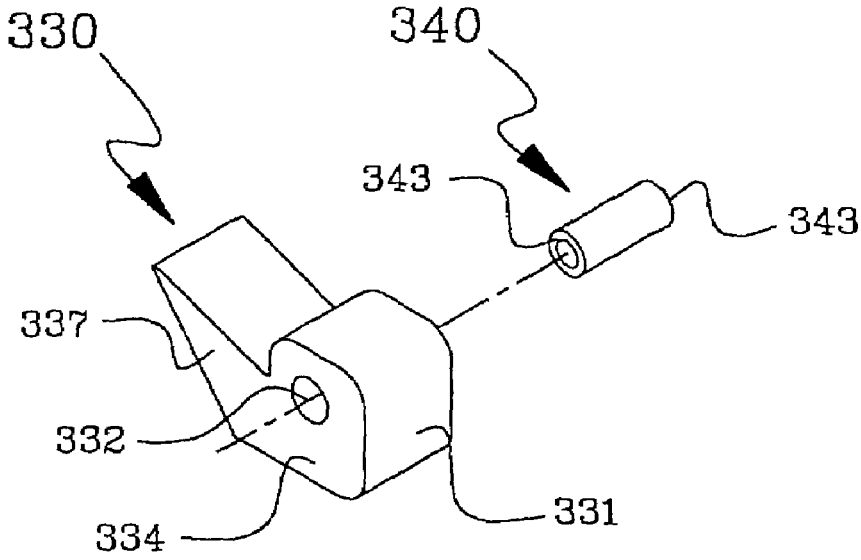
FIGS. 25 and 26 show a perspective and cross sectional view illustrating the cam member of the cam-locking mechanism of the present invention.

FIGS. 23 and 24 also depict a friction pad 310 having a length 312 slightly less than the inside dimension between the side faces. A height 314 of the friction pad, measured from a lengthwise step 315, is slightly less than a dimension measured relative to a bottom side 293 of the margin 278 and the upper vertex of hole 271 (FIG. 25). The width of step 315 is determined from the inside edge of corner 280 to an outer edge 279 of the margin 278. The step 315 has a vertical height 317 equal to or greater than the thickness of edge 279. The friction pad 310 has a front face 319 that has a lengthwise beveled top edge 313.

A cam member 330, shown in FIG. 25, has a bore 332 that intersects with side faces 334. The centerline of the bore 332 is perpendicular with the sides 334 of the cam member. In the preferred embodiment of the present invention the cam member 330 is made of a polymeric material having a thickness of 12.7 mm as measured along the centerline of bore 332. A steel sleeve-bushing 340 having square ends 343 is pressed tightly into bore 332 of the cam member with said square ends abutted with sides 334.

Figure 26:
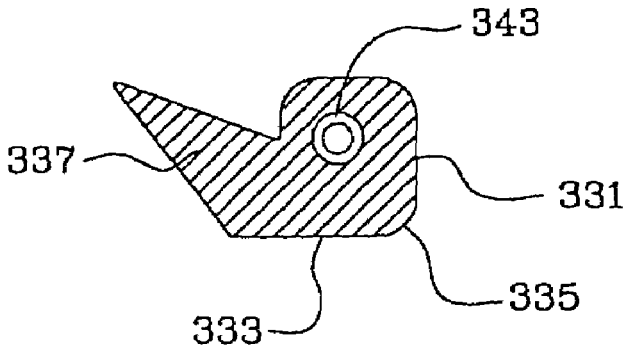
Figure 27:
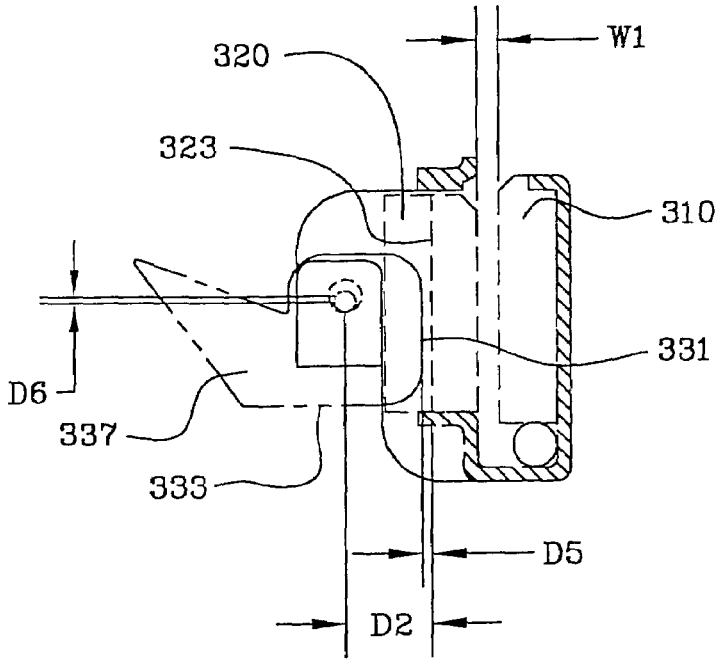
FIGS. 27 and 28 are right and left side perspective views illustrating the cam-locking mechanism unlocked and locked positions.
Figure 28:
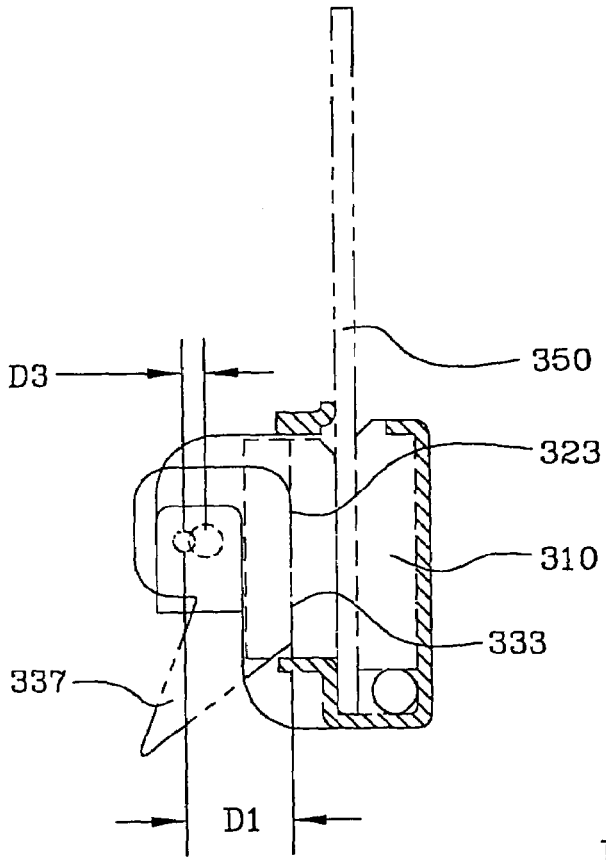

Referring to FIGS. 26–28, the cam member 330 has a profile comprised of a first flank 333 and a second flank 331 both of which are eccentric with respect to each other and about their axis of rotation or the centerline of bore 332. The first flank 333 and the second flank 331 measure a distance D1 and D2, respectively, from the centerline of bore 332. The first and second flanks meet at a ninety-degree corner 335 that is rounded with a generous radius to provide a smooth transition from one flank to the other during use. A lever 337 makes a forty five-degree angle with the first flank 333.

Figure 29:
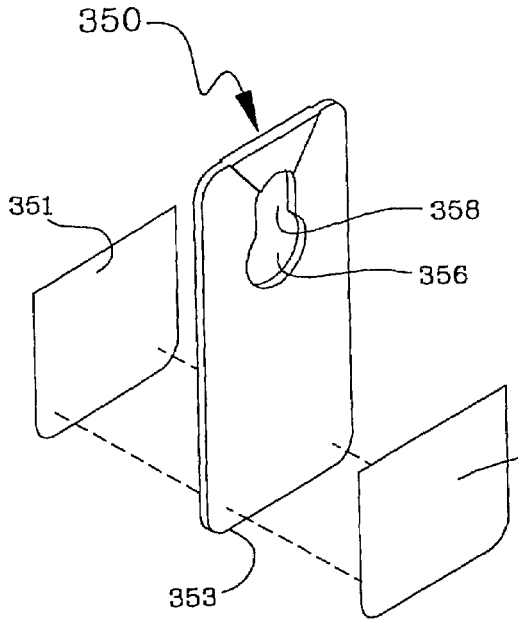
FIGS. 29 and 29A are perspective views of the target of the present invention illustrating the variation in aperture sizes and the use of metal tape adhesive.
Figure 29A:
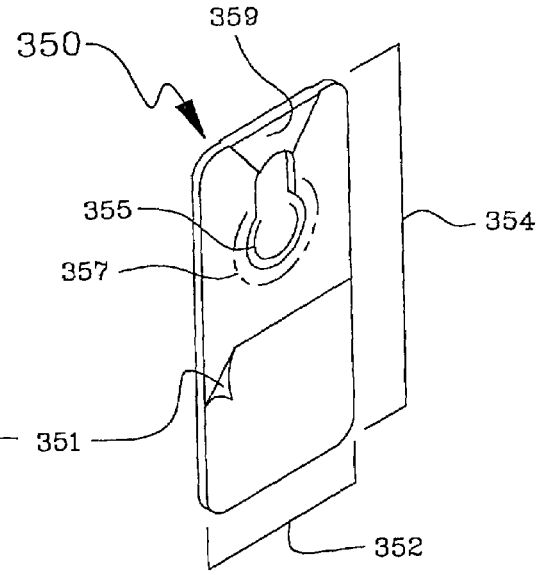

Referring to FIGS. 24 and 25, the golf ball hitting simulation apparatus 207 of the present invention additionally includes a target 350. The target 350 is a planar member that is typically fabricated from nylon, plastic or other suitable materials. In the preferred embodiment of the present invention the target is made of a polymeric material approximately 2.5 mm thick. The target 350 has a width 352 slightly narrower than the inside dimension between the side faces 272 and 274, of the base component 270. A length 354 of the target is determined by the location of a lower aperture 356 relative to the top surface of a swing platform 460. The lower aperture 356 is provided to receive the forward projecting portion 34 of the hook shaft 28 when the golf club 10 is swung on the correct swing path along the target line or in the predetermined manner. The lower aperture 356 connects with an upper aperture 358. The width of the upper aperture 358 equals the diameter of the forward projecting portion 34 of the hook shaft 28, which is smaller than the outer diameter of sleeve 36. Hence, after the sleeve passes through the lower aperture 356 projecting portion 34 of the hook shaft engages the upper aperture 302 hooking the target and a sleeve rear face 35 retains the target connected with the hook shaft. The lower aperture can be enlarged to 357 for a beginner golfer and can be reduced to 355 for a more skilled golfer as depicted in FIG. 29. The target 350 has a reinforcement portion 359 to prevent tears at the vertex of the upper aperture 358. A thin metal adhesive tape 351 is adhered to a lower portion of the target front and rear surfaces (FIG. 29).

Figure 33:
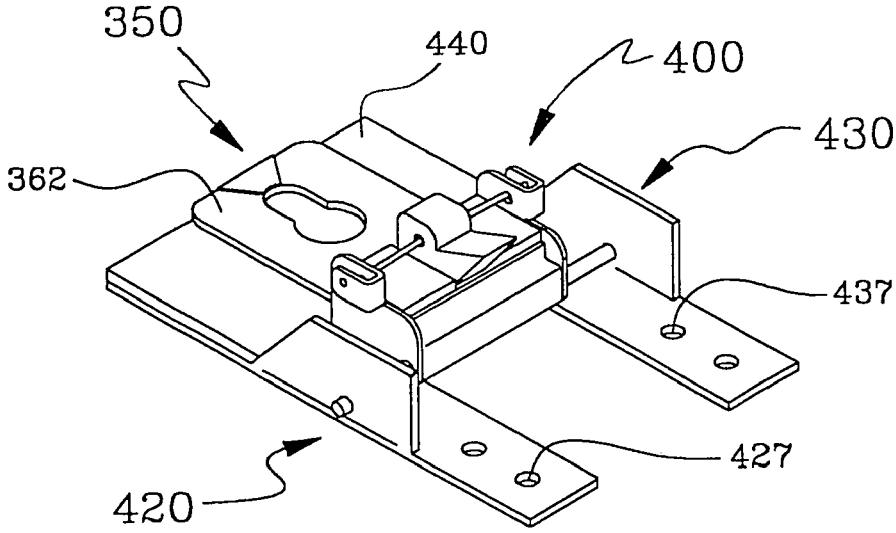
FIG. 33 is a perspective view similar to FIG. 32 illustrating the target and target-mount mechanism in a forward downward pivoted position that is assumed after the target has been struck when a golf club is swung on an incorrect path off line of the target line.
Figure 34:
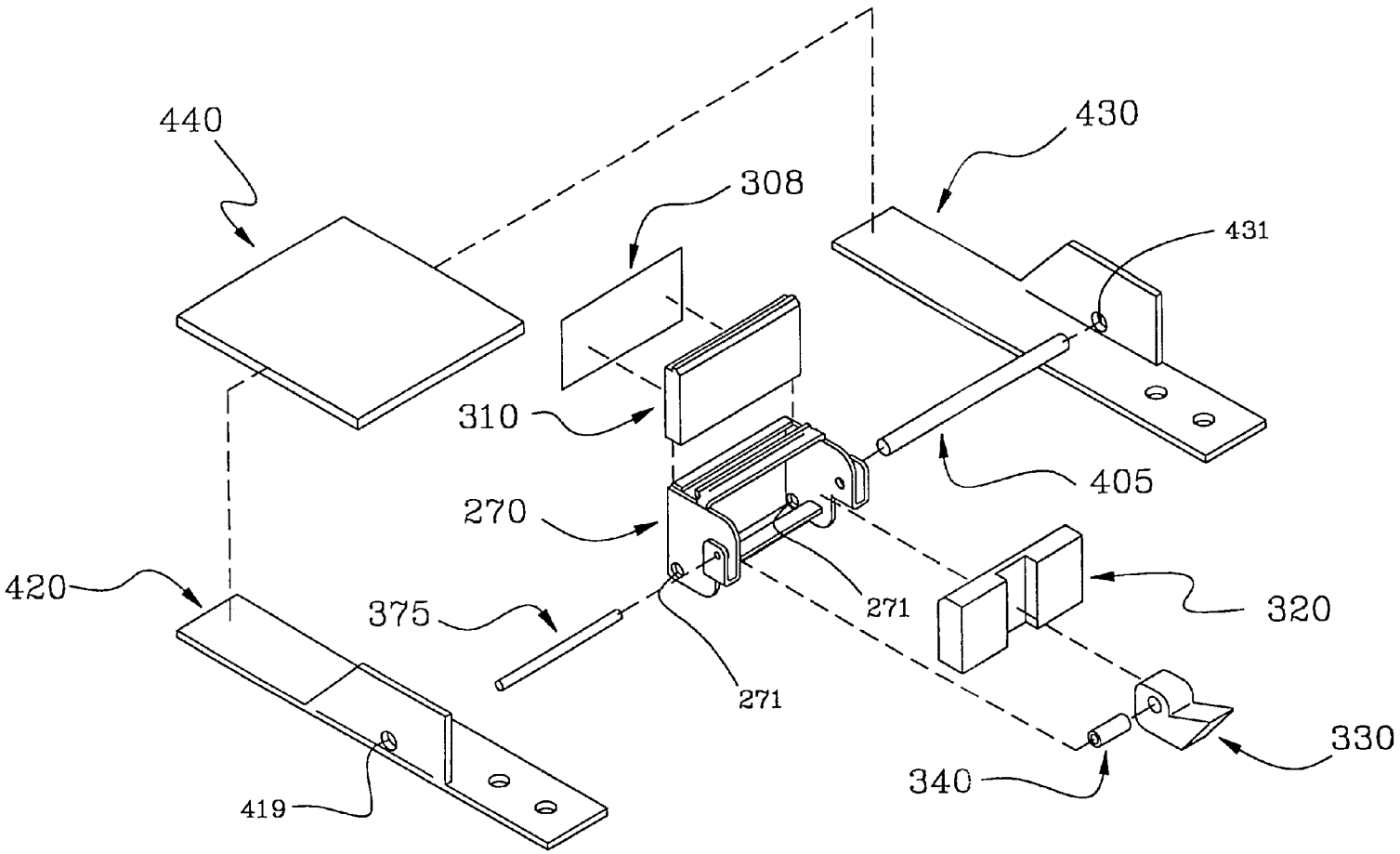
FIG. 34 is an exploded view of the present invention diagramming the assembly of the target-mount mechanism.

Referring additionally to FIGS. 31–35, and more specifically to FIG. 34, a component assembly diagram of the mount 400 is illustrated. In the preferred embodiment of the present invention the friction pad rear face 118 is adhered to the inside of face 276 of the base component 270 using a double-sided adhesive tape 108. The face 276 functions as a stationery plate separated by a slot from relatively moveable clamp plate 320. The bottom side 293 and the edge 279 of the upper margin 278 fits within step 315 of the friction pad 110. The step height 117 extends beyond the edge 279 of the margin 278 to protect the target material against wear. The friction pad bottom face 311 is tangent to the upper vertices of holes 271, of side faces 272 and 274. The beveled edge 313 of the friction pad 310 is opposite the beveled edge 328 of the clamp plate 320. The clamp plate 320 fits loosely floating within the opening defined by channel member 285, side faces 272 and 274, and the lower margin 288. The clamp plate slot 322 captures the cam member sides 334 and centers the cam member 330 at the mid span of a spring wire 375.

Figure 35:
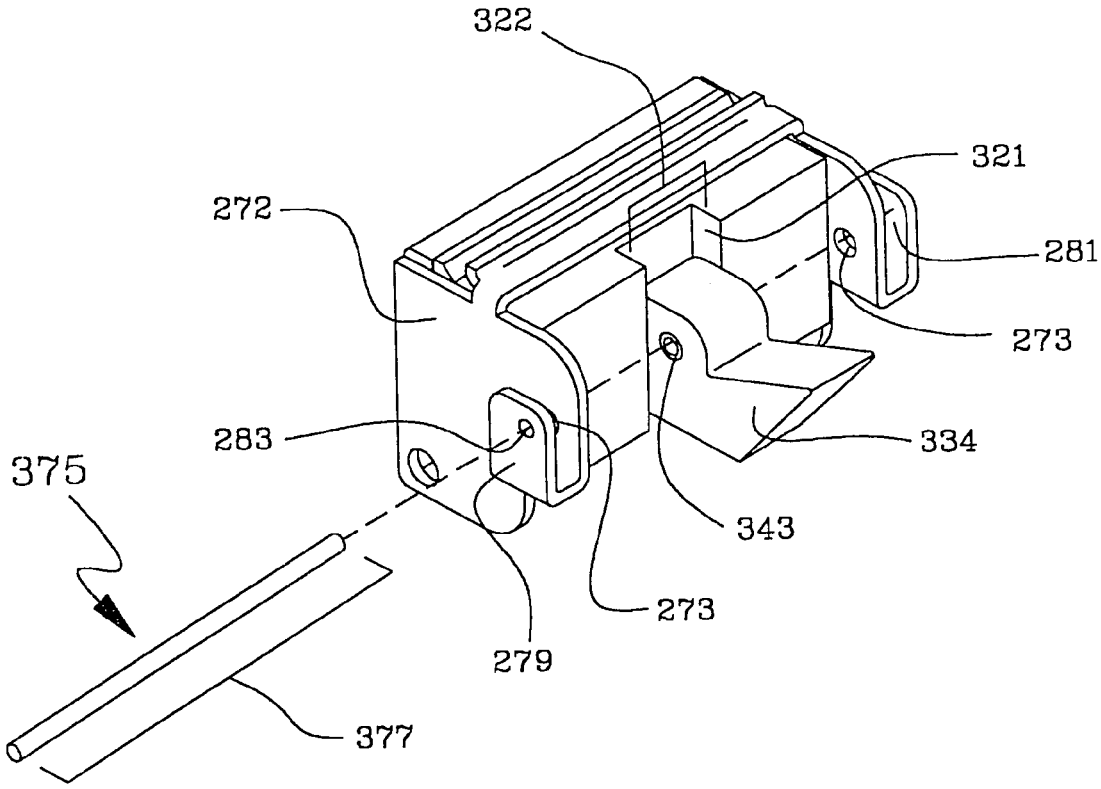
FIG. 35 is a perspective view of the base component of the target-mount mechanism diagramming the assembly of the cam-locking mechanism that includes the spring wire and cam member of the present invention.

Referring additionally to FIGS. 25, 26 and 35, the spring wire 375 is assembled into the base component 270 of the target-mount mechanism 400 to make a cam-locking mechanism. The spring wire has a diameter that is slightly smaller than the diameter of hole 283, both of which are smaller than holes 273 of side faces 272 and 274. The spring wire is generally straight having a length 377 that is slightly less than the perpendicular dimension between the projecting tabs 279 and 281 inside surfaces. An arbitrary end of the spring wire 375 is first inserted through hole 283 of projecting tab 279, through hole 273 of side face 272, through the steel sleeve 343 of the cam member 330 and finally through hole 273 of side face 274 before stopping against projecting tab 281. Subsequently the spring wire 375 drops a short distance D6 (FIG. 25) and is supported at its extreme ends by the lower vertices of holes 273 while being constrained from moving laterally by the inner surfaces of projecting tabs 279 and 281.

Because the clamp plate slot 322 captures the cam member sides 334, the cam-locking mechanism is constrained form lateral movement along the spring wire 375 in both its locked and unlocked position. When the cam-locking mechanism is in an unlock position the second flank 331 of the cam member is parallel to the slot bottom 323 as shown in FIG. 27. In the unlock position, a gap width W1 and a clearance D5 exist between the second flank 331 of the cam member and the slot bottom 323. The gap width W1 is at least equal to the thickness of the target 350. The clearance D5 allows the clamp plate 320 to move rearward to facilitate insertion of targets having various thicknesses between the clamp plate 320 and friction pad 310 with minimal effort. A thicker target causes the retention force to be increased for more skilled practitioners. The bevel edges 328 and 313 of the clamp plate and friction pad helps a user to engage the bottom edge 353 of the target into the gap W1.

Figure 31:
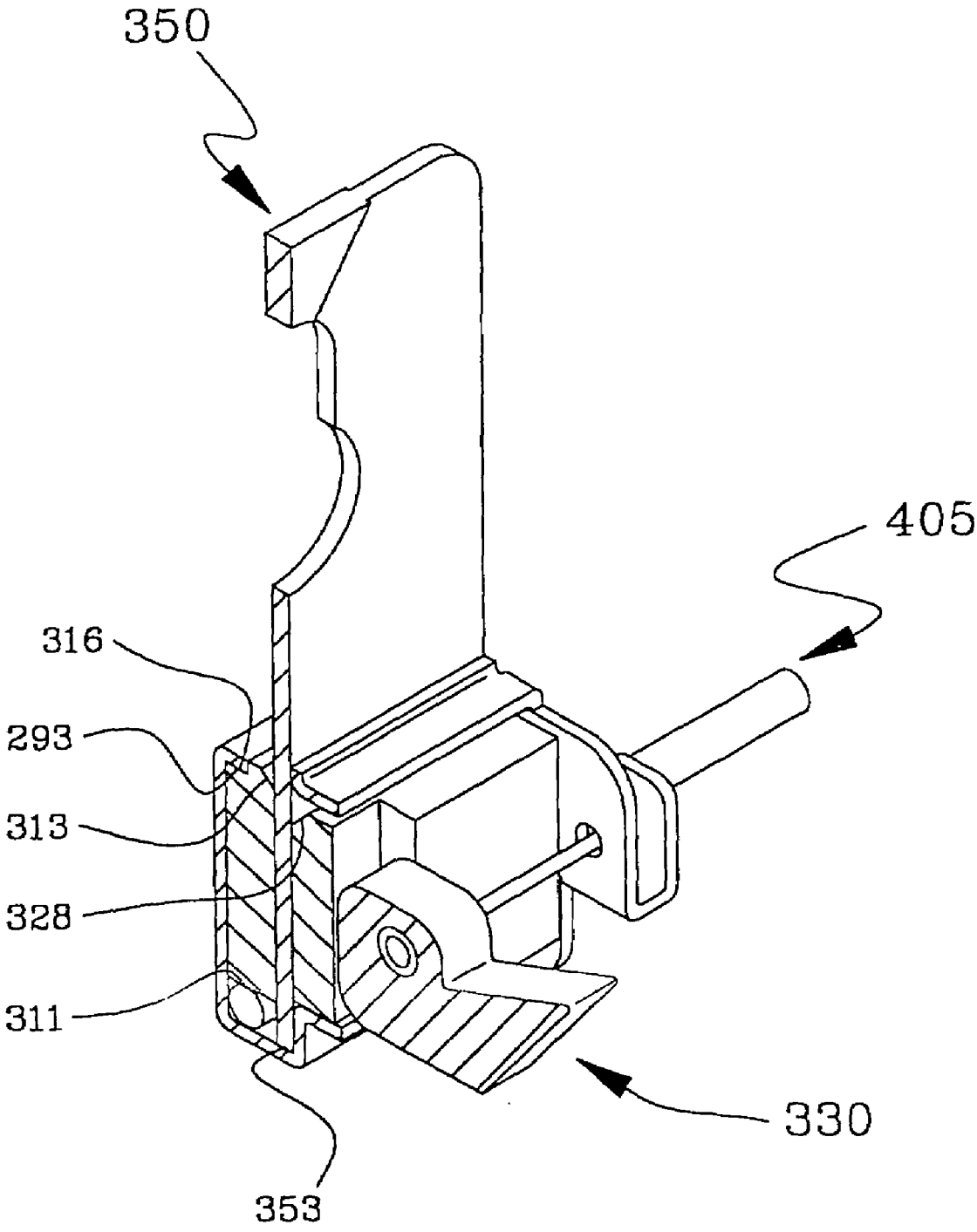
FIG. 31 is a perspective view of the target-mount mechanism of the present invention partially sectioned illustrating positioning of the target, the friction pad, the clamp plate and the pivot shaft.
Figure 32:
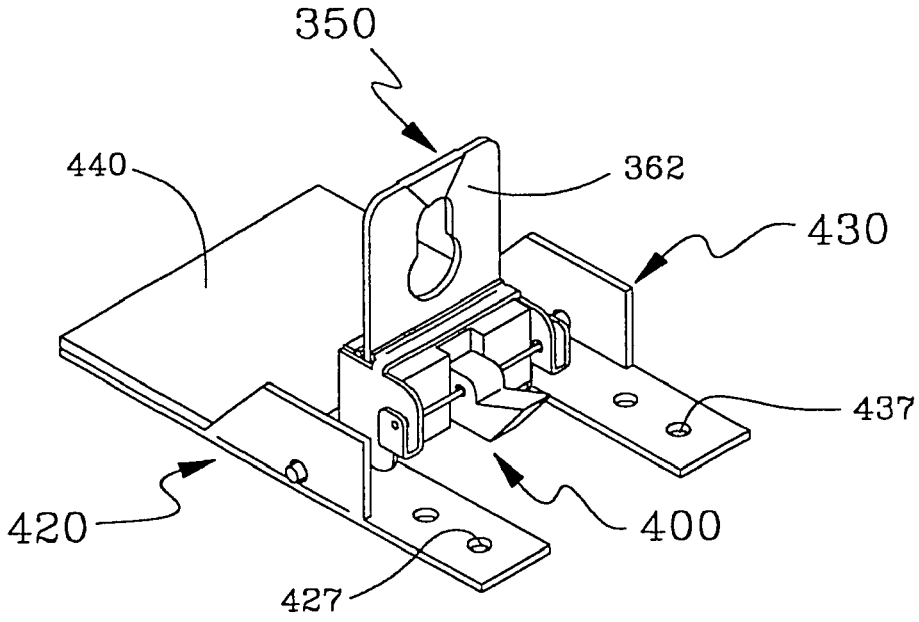
FIG. 32 is a perspective view illustrating the target-mount mechanism with an installed target in an upright position.

Referring to FIG. 12 and in particular to FIG. 31, for clarity of illustration one side of the mount, together with the target, is sectioned about the cam-locking mechanism centerline (shown in the unlocked position). A target is inserted into the mount 400 until the bottom edge 353 of said target contacts the bottom 82 of the base component 270. The lever 337 makes it easy for the cam member to displace the spring wire 375. As the cam member 330 of the cam-locking mechanism is rotated towards a locked position, the cam nose 335 first contacts the slot bottom 323 and starts to displace the spring wire 375 rearward (away from the target). Subsequently, the cam nose continues to displace the spring wire (a distance D3) until the flank 333 of the cam profile snaps firmly against the clamp plate slot bottom 323. The reaction force of the spring wire 375, caused by the displacement D3, is applied to a target area 368. The distance D3 is predetermined and equals the difference between D2 and D1 whereby D2 is approximately equal to or may vary as a function of the gap width W1 (refer to FIGS. 27 and 28).

The mount 400 receives a round pivot shaft 405 through side holes 271. The shaft 405 extreme ends are received by a circular hole 419 in a left hand support bracket 420 and a circular hole 431 in a right hand support bracket 430. The target-mount mechanism 400 is located mid span of the pivot shaft 405 between the left and right hand support brackets. The target-mount mechanism 400 is free to rotate about the pivot shaft from a vertical to a horizontal position (refer to FIGS. 32 and 33).

Figure 30:
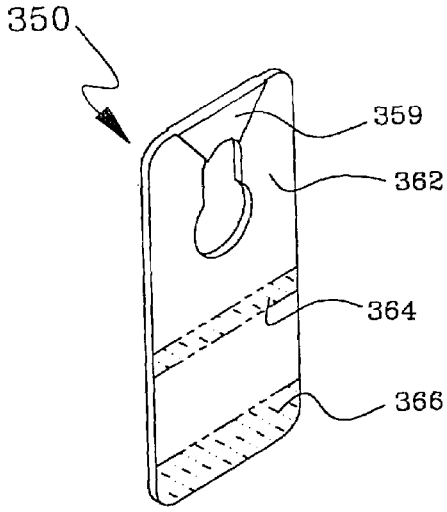
FIGS. 30 and 30A are views of the target shown in FIG. 29 illustrating areas that are recipient of impact forces and shaded areas that counteract with impact forces.
Figure 30A:
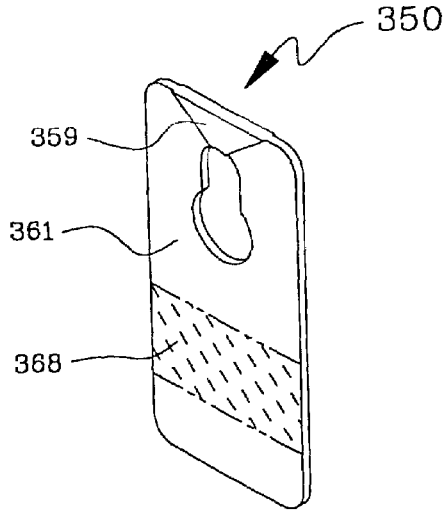

Referring to FIGS. 29, 30, 32 and 33, when the golf ball hitting simulation apparatus 207 of the present invention is used, the target 250 is clamped within the target-mount mechanism. The target width 252 is perpendicular to the target line and the target line goes through the center of the lower part of the aperture 256. The target has an impact area 362 and 361 of which the lower and upper apertures 356, 358 are centrally located (FIGS. 29 and 30). The impact area 362 is bounded by an upper edge of shaded area 364 and the top and side edges of the target 350. The impact area 361 is bounded by an upper edge of shaded area 368 and the top and side edges of the target 350. When a golf club is swung along an incorrect swing path off of the predetermined target line the impact head 38 of the hook shaft 328 strikes the area 362 of the target 350 after which the target-mount mechanism 400 will retain the target 350 while pivoting downward about the pivot shaft 405 until the target area 361 impacts with a pad 440 (FIG. 33). To minimize rebound or bounce back of the target-mount mechanism 400 and target 450, the pad 440 (preferably an elastomeric dampening sheet) is attached to the left and right hand support brackets 420 and 430, respectively.

Referring additionally to FIG. 30, the accelerating force of the impact head 38 against the target area 362 reacts with a shaded area 366 of the target, which is absorbed by the bottom rear face 286 of the base component 270 of the target-mount mechanism while another area 368, also shown shaded, of the target reacts against the friction pad 310. The decelerating force resulting from target area 361 impacting the pad 440 reacts against the shaded area 364 of the target, which is absorbed by the vertical side 294 of the channel member 285 of the base component 270. The surfaces 294 and 286 of the base component protect the spring wire 375 form large impact forces received by target areas 361, 362 hence preventing the spring wire from plastic deformation.

Figure 36:
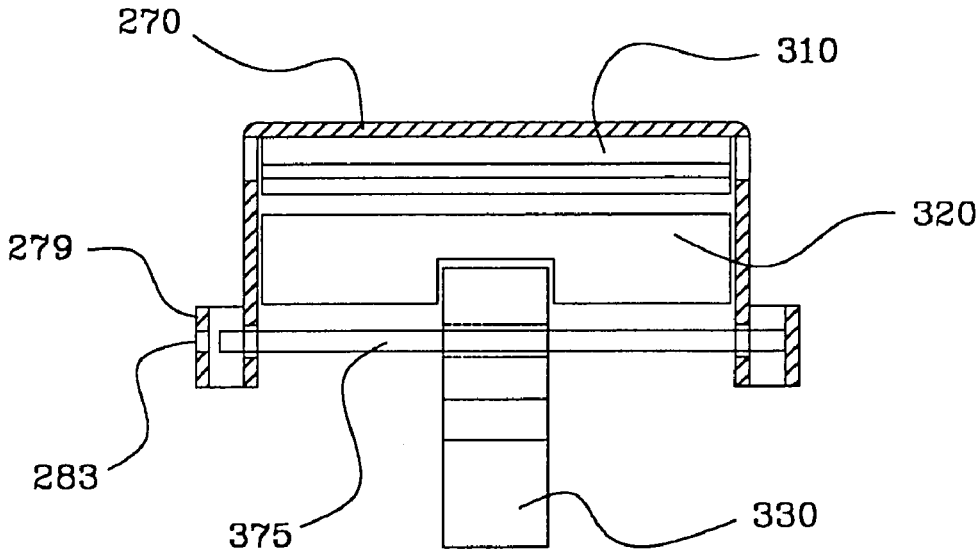
FIGS. 36 and 37 are top perspective views of the target-mount mechanism of the present invention illustrating the configuration and shape of the spring wire when the cam-locking mechanism is in an unlocked and locked position.
Figure 37:
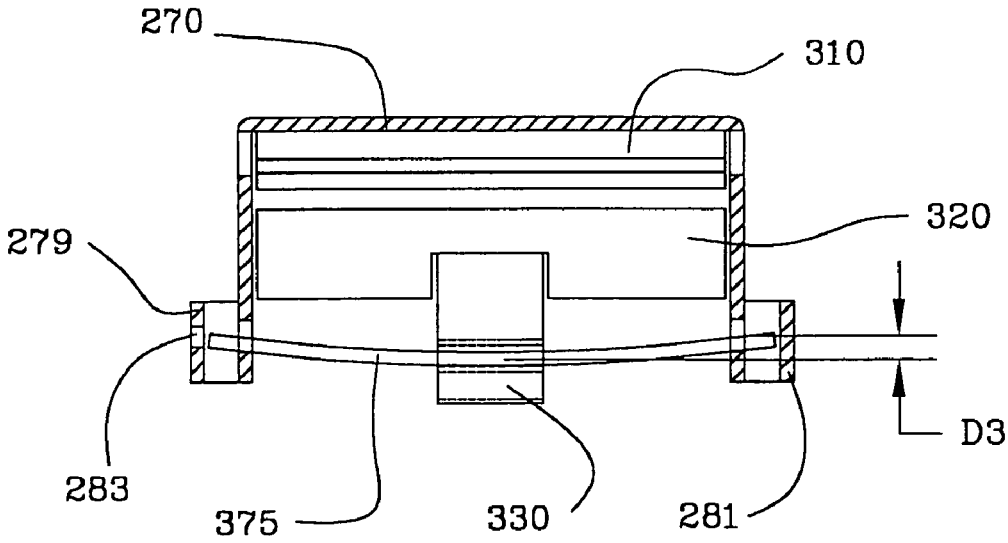

FIG. 36 depicts a straight spring wire, which is typical when the cam member 330 of the cam-locking mechanism is in an unlocked position. FIG. 37 depicts a curved spring wire, the shape of which is determined by spring displacement D3, and is typical when the cam member 330 of the cam-locking mechanism is in a locked position. A plastically deformed spring wire cannot be displaced D3 since it is permanently curved along its length. The deformed spring wire can only be displace an amount less than D3 and therefore will not generate enough force required to keep the target retained in the target-mount mechanism causing the cam-locking mechanism to fail its intended function.

A primary function the cam-locking mechanism is to hold and prevent the target 350 from dislodging when the target area 362 is struck by the impact head 38 of the hook shaft 28 or after the target area 361 strikes the pad 240 (FIG. 33). This allows a practitioner to return the target-mount mechanism and target to an upright position (FIG. 32) without having to reset the target each time after impact. If however, the target 350 moves slightly and requires minor adjustment in the target-mount mechanism 400 this can be easily accomplished due to the quick release cam design feature of the cam-locking mechanism. The static coefficient of friction between the target 350 and the friction pad 310 in the presence of a normal force firmly holds the target 150 in the target-mount mechanism 200. Conversely, a normal force or clamping force too great will hold the target too firmly causing it to tear as the hook shaft 28 projecting portion 34 is swung through the upper aperture 358 of the target.

Figure 38:
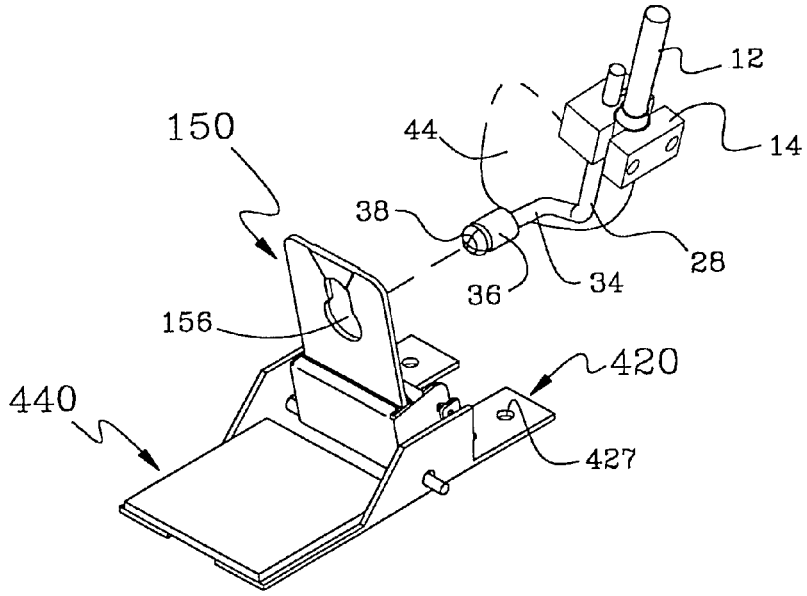
FIGS. 38, 39 and 40 are operational views illustrating the connection of the latch member with the target when the golf club of the present invention is swung on the correct path along the target line.

Referring additionally to FIGS. 34–38, when the golf ball hitting simulation apparatus of the present invention is used by a practitioner who swings the golf club in the predetermined manner; that is, on the correct swing path along the target line and square to the target (or square to the ball at impact) the impact head 38 will enter into the lower aperture 356. As the rear face 35 of the sleeve 36 of the hook shaft 28 passes through the lower aperture 156, the apex of the upper aperture 158 will then be engaged onto the forward projecting portion 34 of the hook shaft 28 (FIG. 38). The target 350 will now be captured behind the rear face 35 of the sleeve 36. A continuing forward swing as depicted in FIG. 41 instantaneously snatches the target from the target-mount mechanism during which the practitioner will feel recoil followed by visual confirmation that the swing was proper, as the target will remain connected with the hook shaft 28 until the practitioner removes it.

Figure 39:
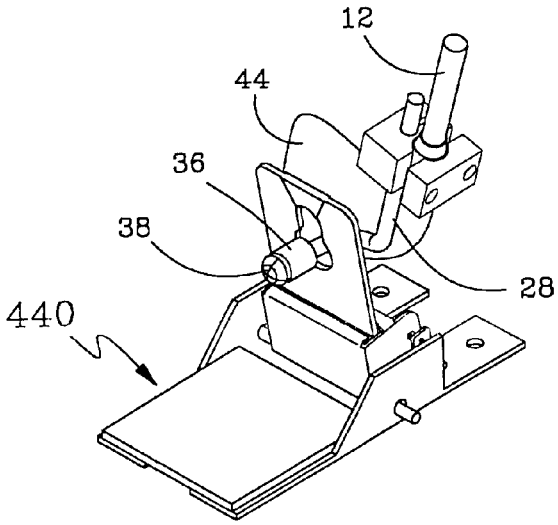
Figure 40:
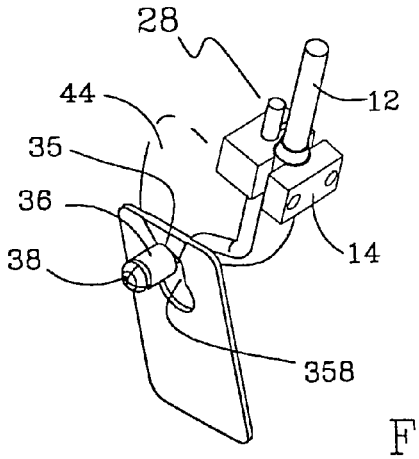

Since friction holds the target firmly in place and the magnitude of the relative velocity between the target and friction pad is high as the target is instantaneously removed from the target-mount mechanism, some heat is dissipated. The dissipating heat can melt the target, which is made of a plastic material in the embodiment of the present invention, leaving behind an extremely thin layer of a plastic film on the friction pad 310. This film of target material significantly reduces the static and dynamic coefficient of friction characteristic of the friction pad and subsequent impact forces against the target will easily expelled the target from the target-mount mechanism. To prevent the target material used in embodiment of the present invention from melting a thin sheet of metal adhesive tape 351 is adhered to the lower portion of both sides of the target with its top edge aligned with the top edge of the shaded target area 368 (FIG. 39). In an alternate preferred embodiment of the present invention the target can be made from a polymeric material having a higher melting point to withstand melting during frictional heat dissipation.

Figure 41:
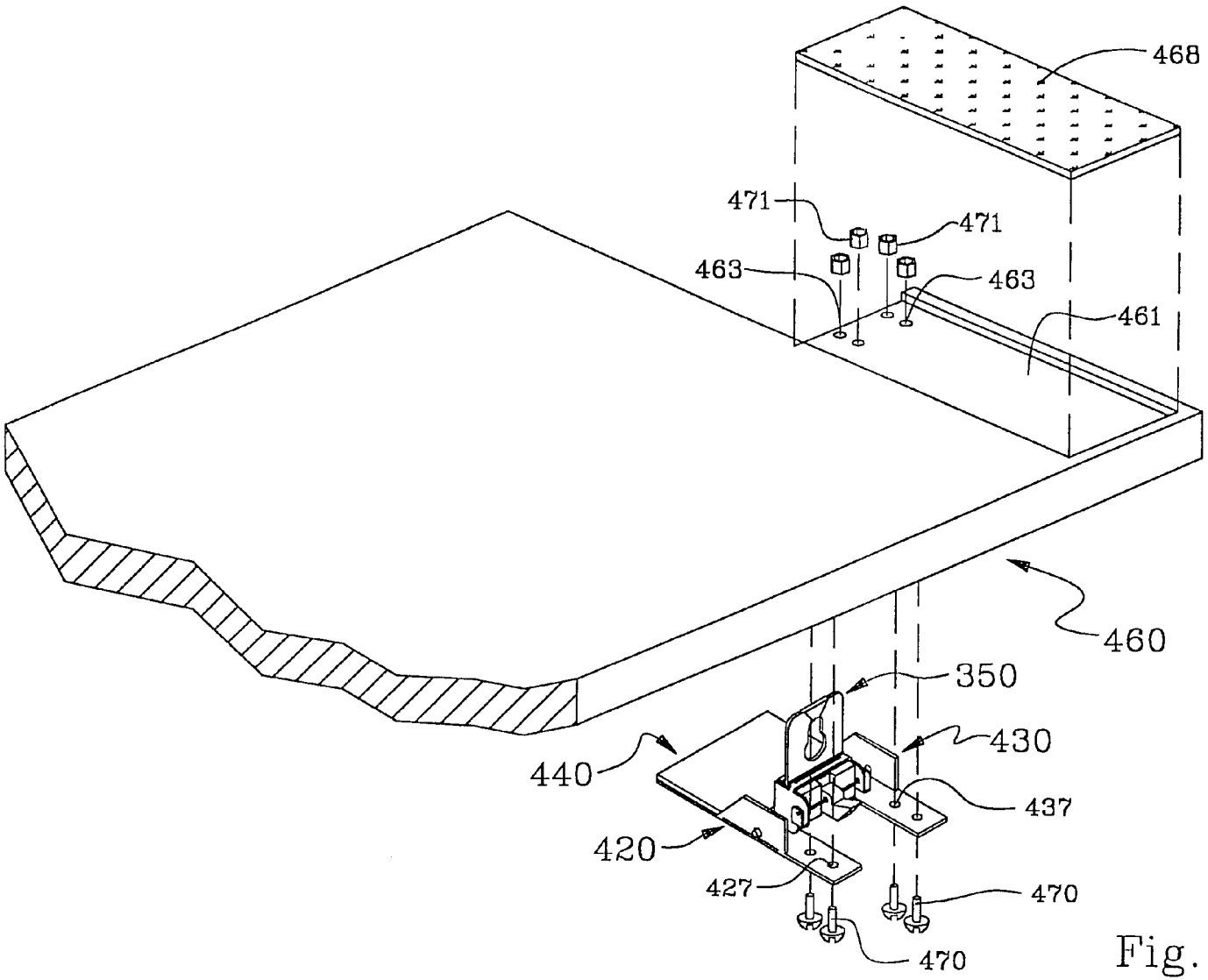
FIG. 41 is an exploded view of a portion of a swing platform of the present invention to which the target-mount mechanism is connected.
Figure 42:
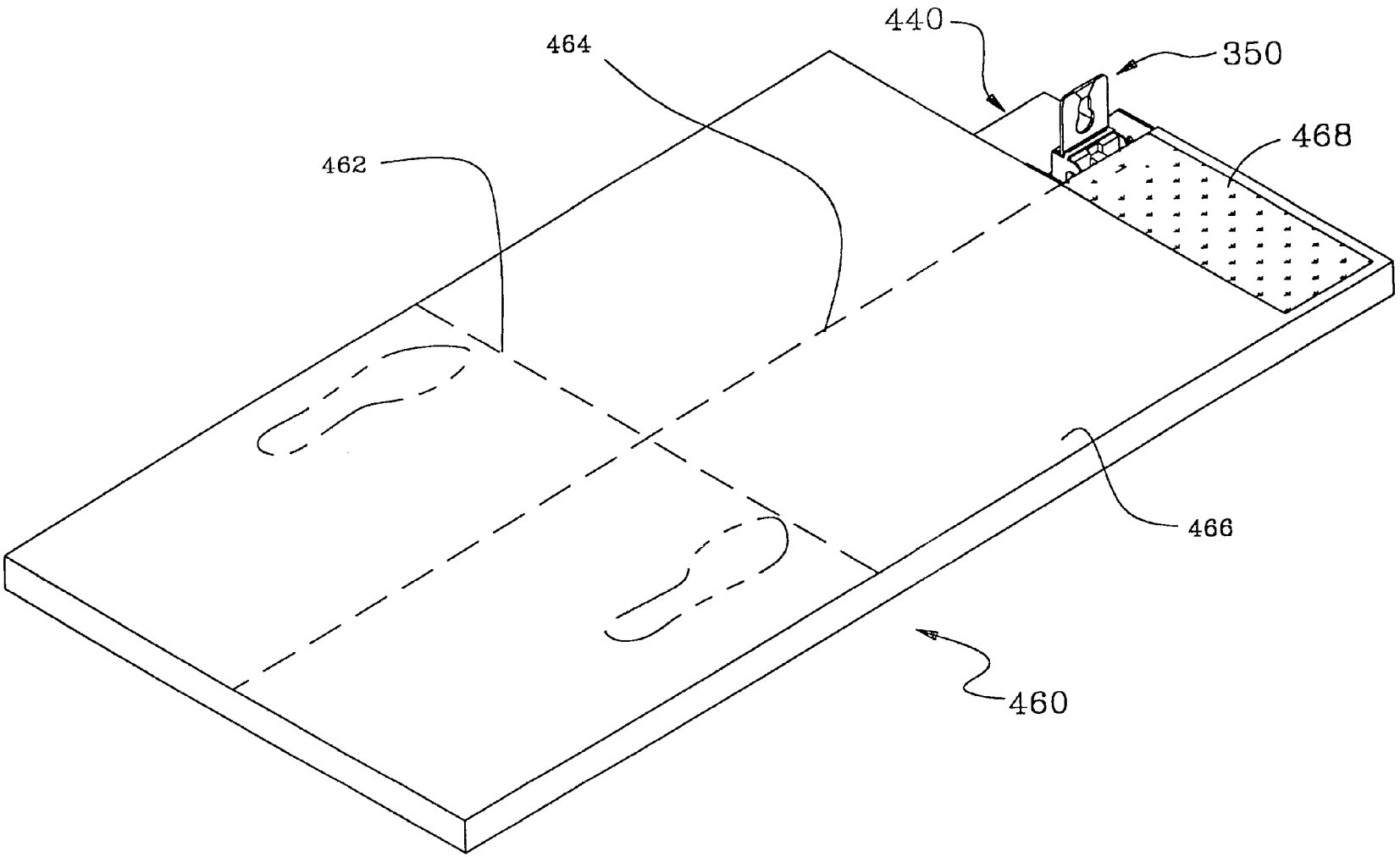
FIG. 42 is a perspective view of a swing platform utilized with the golf club of the present invention.

Referring to FIGS. 41 and 42, the swing platform 460 may optionally have crossing lines 462 and 464 to provide practitioners with general alignment references for positioning themselves relative to the target. A lower portion 461 having a plurality of bores 463 can be covered with a turf appearance type carpeting cover 468. The left hand support bracket 420 and right hand support bracket 430 each have a pair of circular holes 427 and 437, respectively. The target-mount mechanism 400 with the left hand and the right hand support brackets connected with the pivot shaft 405 is connected with the swing platform with threaded fasteners 470 and threaded nuts 471. To prevent the target mount mechanism 400 from being impacted by the impact head 38 a top surface 466 of the swing platform 460 will be higher than an uppermost surface of the target-mount mechanism 400 when the left hand and right hand support brackets 420, 430 are mounted to the bottom surface of the platform. When the target is properly installed in the target-mount mechanism the bottom vertex of the lower aperture 356 of the target will be sufficiently higher than the top surface 466 or covering 468 of the swing platform 460 in order to receive the projecting portion 34 of the hook shaft 28.

Figure 43:
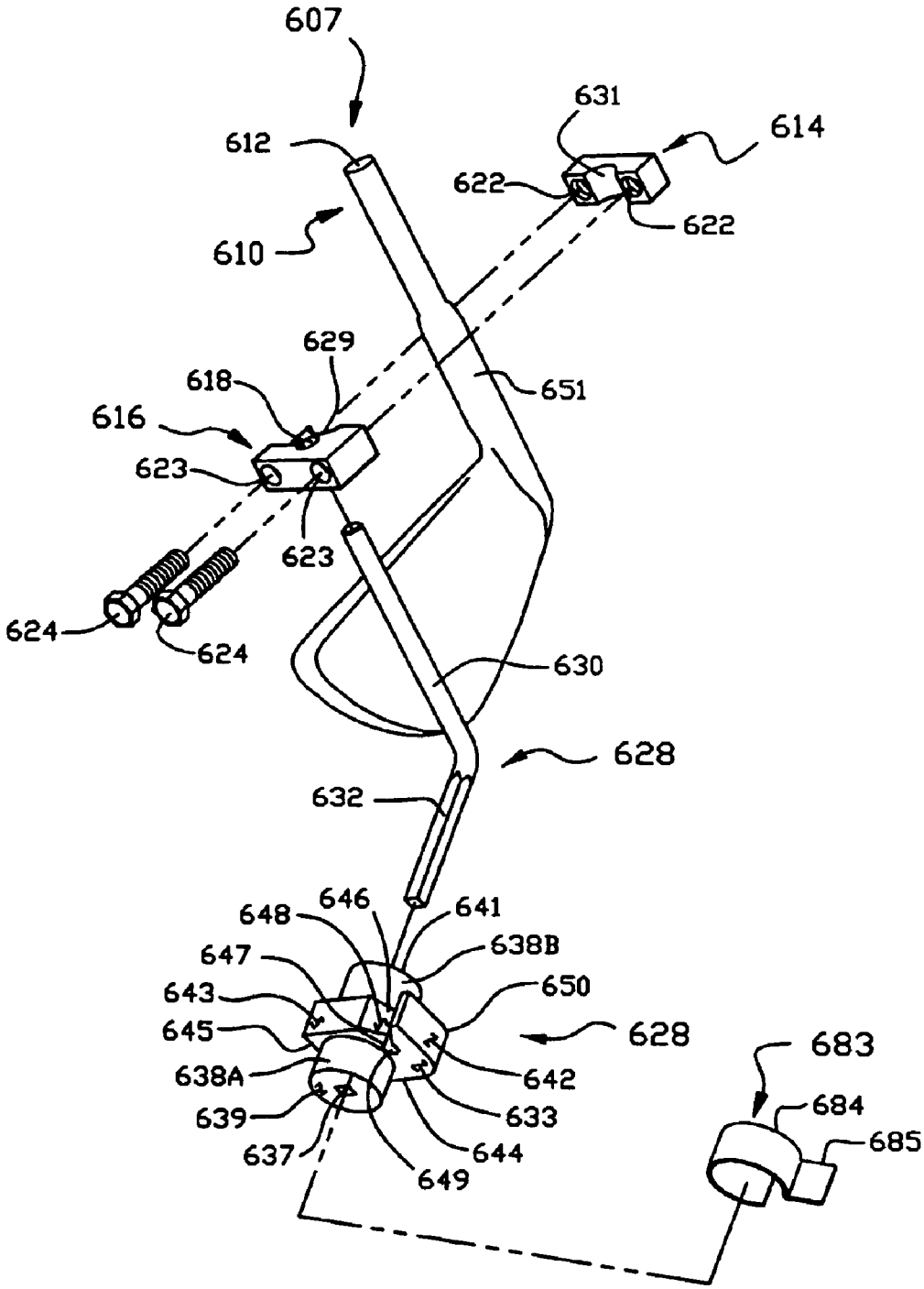
FIG. 43 is a the exploded view of the lower portion of a golf club, notably an iron, showing the latch member and the mechanism allowing for an adjustment and attachment of the latch member on a golf club.
Figure 43A:
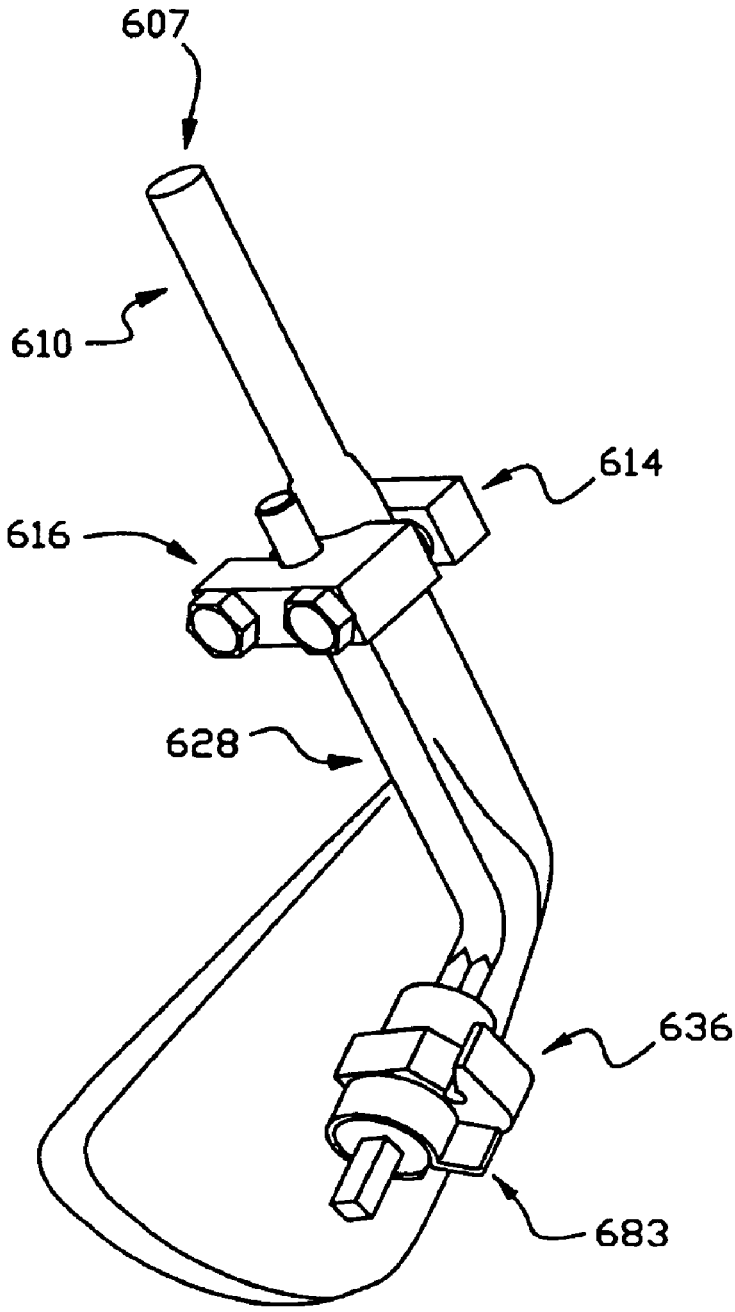
FIG. 43A is a view of the lower portion of the golf club shown in FIG. 43.

Referring to FIGS. 43 and 43A, the present inventive golf ball hitting simulation apparatus 607 includes a golf club 610 having a shaft 612. An extreme lower end 651 of the shaft sometimes referred to as a hosel or neck has clamped thereto a pair of clamping members 614 and 616. The clamping member 616 has a bore 618 through a top and a bottom side and a pair of bores 623 that are typically not threaded. The clamping member 614 has a pair of bores 622 with centers that are coaxial with the centers of bores 623 of clamping member 616. Typically, bores 622 will be threaded to receive threaded fasteners provided by screws 624. Clamping members 616 and 614 have a semi-bore 629 and 631 of which the centerline is midway between bores 623 and 622. The hosel 651 of the golf club is captured by the semi-bores 629 and 631 as the clamping member 616, 614 are adjustably connected to the hosel 651 with screws 624, as shown FIG. 43A, an assembled view of the preferred embodiment of the present invention.

Figure 52:
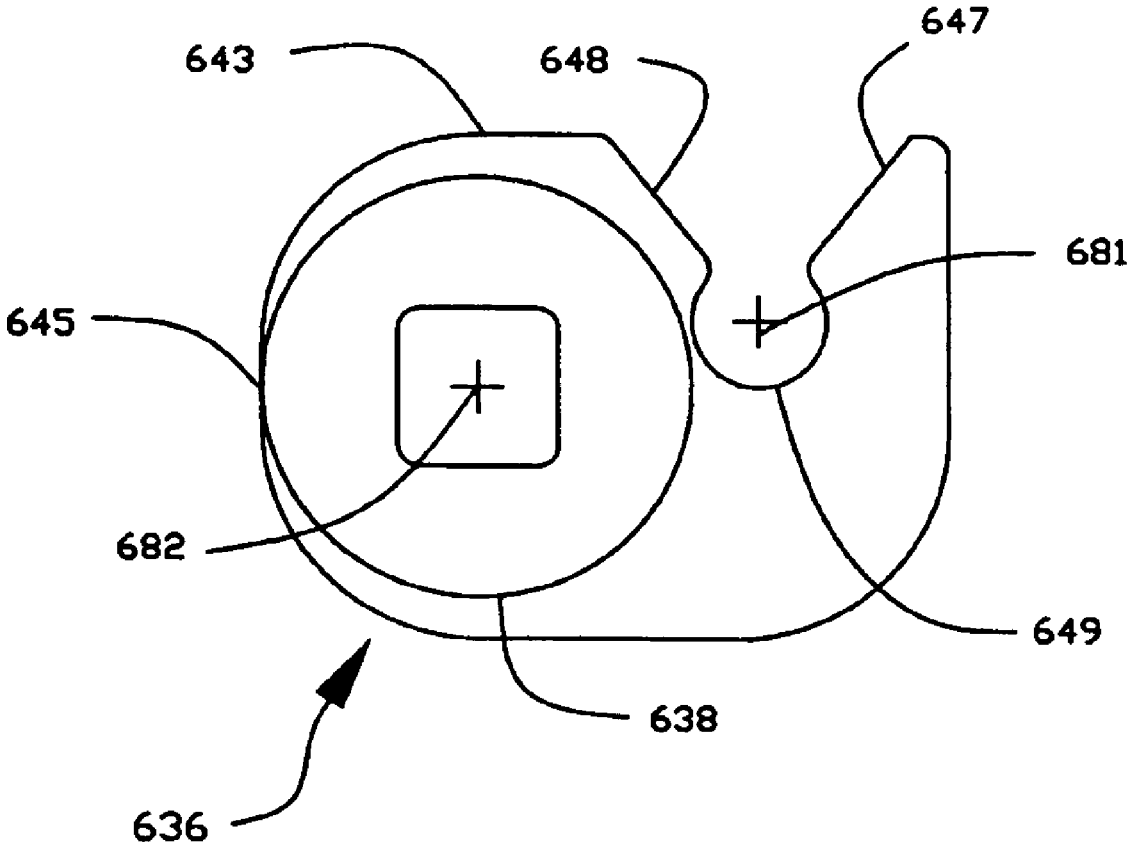
FIG. 52 is a side elevation of view of a hook portion of a latch member shown in FIG. 43.

A steel rod hook shaft 628 has a first elongated portion 630 that forms an obtuse angle with a second elongated portion 632. The elongated portion 630 has a diametric cross section that is positioned within the bore 618 of clamping member 616. The second portion 632 has a square cross section that is positioned within a square hole 637 to receive thereon a latch member 636. The latch member 636 is often fabricated from a metal or preferably from a polymeric material such as plastic. Referring additionally to FIG. 52 the latch member 636 has a hook portion 633. The hook portion 633 projects forward generally perpendicular to the hook shaft second elongated portion 632. The hook portion 633 has a cross section that generally matches an aperture in the target. Typically, the hook portion 633 has a polygonal crossectional shape and as shown is rectangular or square. The latch member 636 has cylindrical inboard and outboard curvilinear contact portions 638A & 638B lateral of the hook portion 633. The curvilinear contact portions 638 A&B provide surfaces that contact and support the target when the hook portion 633 is penetrativly received into a target aperture. The contact portion 638 curvilinear surfaces lower stress on the target and lead to longer target life. Additionally the cylindrical bodies of the contact portions 638 help to distribute the torque loading of the hook portion 633 on the hook shaft elongated portion 632. The contact portions 638 A&B have side faces 639 and 641.

The hook portion 633 projects perpendicularly with respect to the longitudinal axis of the latch member 636 and is located midway between side faces 39 and 41. The hook portion 633 has a front face 642, a top face or surface 643, a bottom face 644, and a rear face 645. Typically, the rear face 645 and the bottom face 644 have two edges that are parallel with the longitudinal axis of the latch member 636. Typically at least one edge of the rear face 645 and the bottom face 644 intersects along a tangent of the cylindrical curvilinear surface of the contact portion 638. A radius corner 650 joins the front face 642 and the bottom face 644 which, together from a ninety-degree angle.

The top face 643 has an intersecting major notch 646 which can be v-shaped as shown. In another embodiment (not shown), the major notch may look more u-shaped As shown the major notch 646 is comprised of a frontward face 647 and a rearward face 648 that are preferably angled between 70 and 85 degrees and as illustrated are 77 degrees apart from one another. A sub notch 649 intersects the bottom end of the major notch 646. A small bore that has a cylindrical surface forms the sub notch 649. The surface of the sub notch projects generally tangentially with the curvilinear surface of the contact portions 638. A top of the sub notch forms a gap 657 that has an interference fit with the thickness of the target adjacent the aperture 686 of the target. It is preferable that the gap 657 be 90–60% of the thickness of a target and in many applications 75% will be preferable. The interference fit aids in retaining the target with the hook portion 633 when the golf club 610 is swung properly. A centerline 681 of the sub notch is typically forward and slightly above a centerline 682 of the contact portions 638 when the hook portion 633 enters the target aperture.

Figure 53:
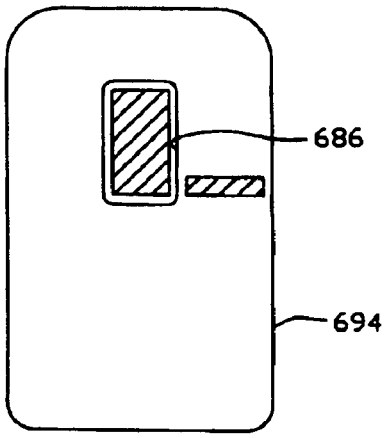
FIG. 53 is a partial sectional schematic view illustrating a hook portion of a latch member and a tip of an expert tab upon approaching a target during a swing of a golf club as shown in FIG. 43.
Figure 54:
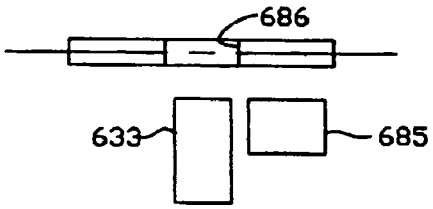
FIG. 54 is a schematic view of the hook portion of the latch member and expert tab approaching a target when the golf club is swung in a square manner.
Figure 54A:
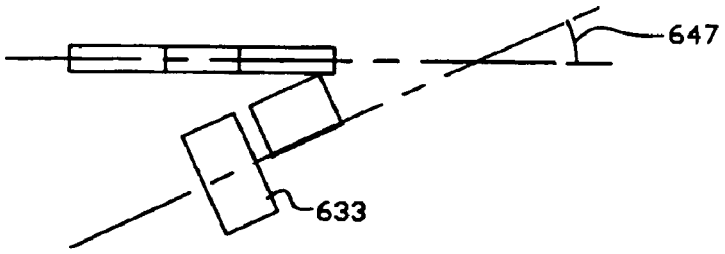

A novice or intermediate player may be happy with a shot of 250 yards that is just 10 or 15 yards to the right or left of target from a straight line shot. However for an expert such as a club professional or a tour player it is desirable to have a practice apparatus which can aid in achieving even more directionally true shots. Referring additionally to FIGS. 53, 54 and 54A an expert tab 683 is presented. The expert tab 683 is typically a thin sheet metal or polymeric member having a body 684 with an extending tip 685. The body 684 has a slight interference fit with one of the contact portions 638 to allow it to be stationary, but to also allow it to be deformed or rotatively pivoted if urged to do so. Squareness of the club face to the ball is a matter of a quantifiable angle within predefined tolerances. FIGS. 53 and 54 are schematic sectional and top plan views of the hook portion 633 and the expert tab 683 when the club is swung in a true square manner typical of a golf pro. Since the hook portion 633 engages the target aperture 686 before the tip 685 of the expert tab can hit the target the hook portion 633 will penetrate the target aperture 686 and pull the target 694 away from its mount. The expert tab will simply be deformed or be pivoted out of the way. FIG. 54 A illustrates an off square swing with the angle off from expert squareness greatly enlarged for purposes of illustration. When the golf club face is not square the expert tab tip will first hit the target causing the target to move and preventing the hook portion 633 from penetrating the target aperture 686. To require a higher skill level, a smaller aperture size with less clearance could be used. However in many cases the professional player will realizes that they have a tendency on a 250 yard shot to be 10–15 yards to the right or left. For a right hand player, the shot going off to the left would imply that the "toe" end of the club face is slightly forward. To train to improve this stroke the expert tab will be placed on the contact portion 638A. If the shot fading to the right is a problem the expert tab will be placed toward the club hosel heel and be connected on the contact surface 638B. The above is reversed for a left hand player.

Figure 44:
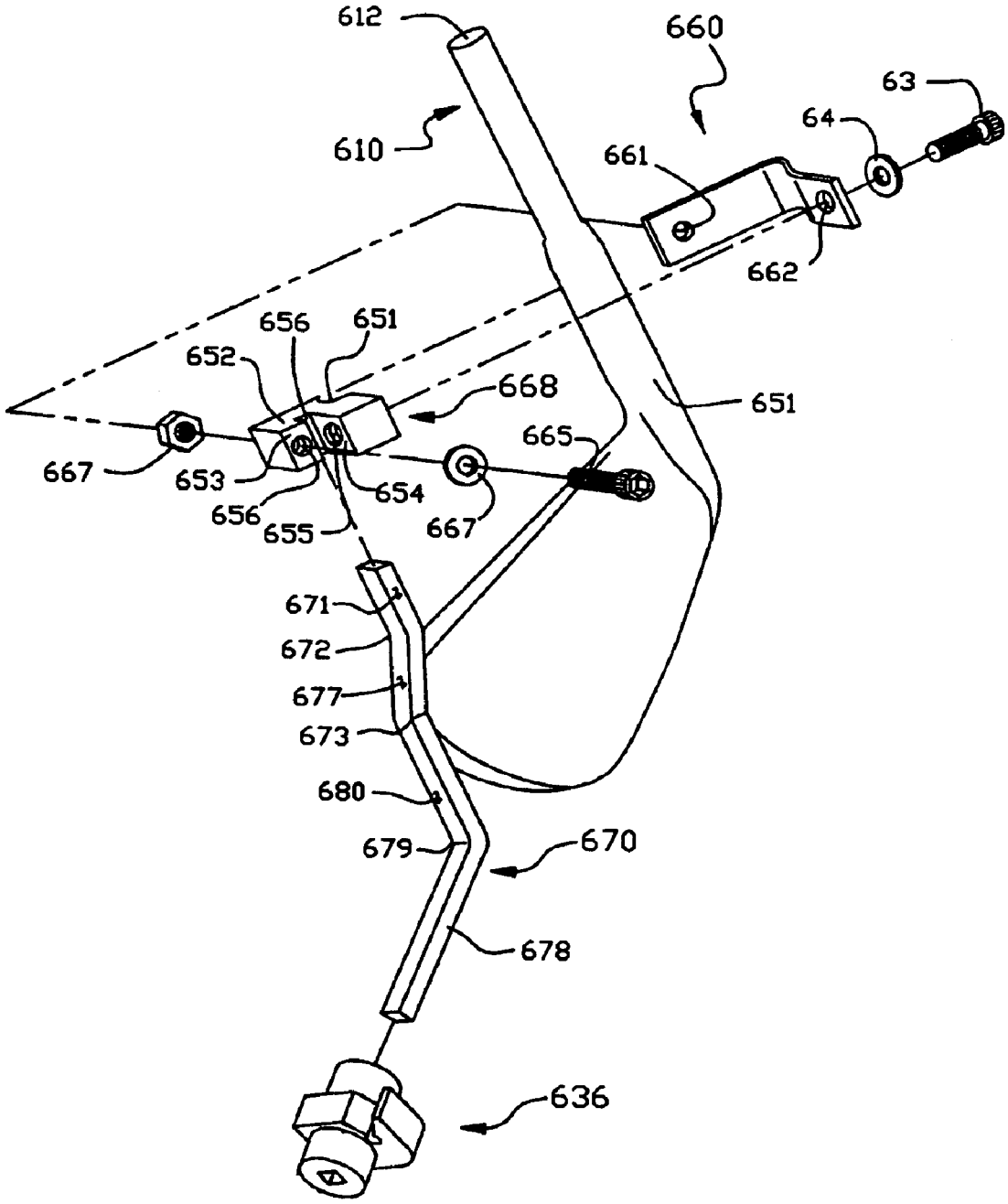
FIG. 44 is a view similar to FIG. 43 illustrating a latch mechanism with a square shaft.
Figure 44A:
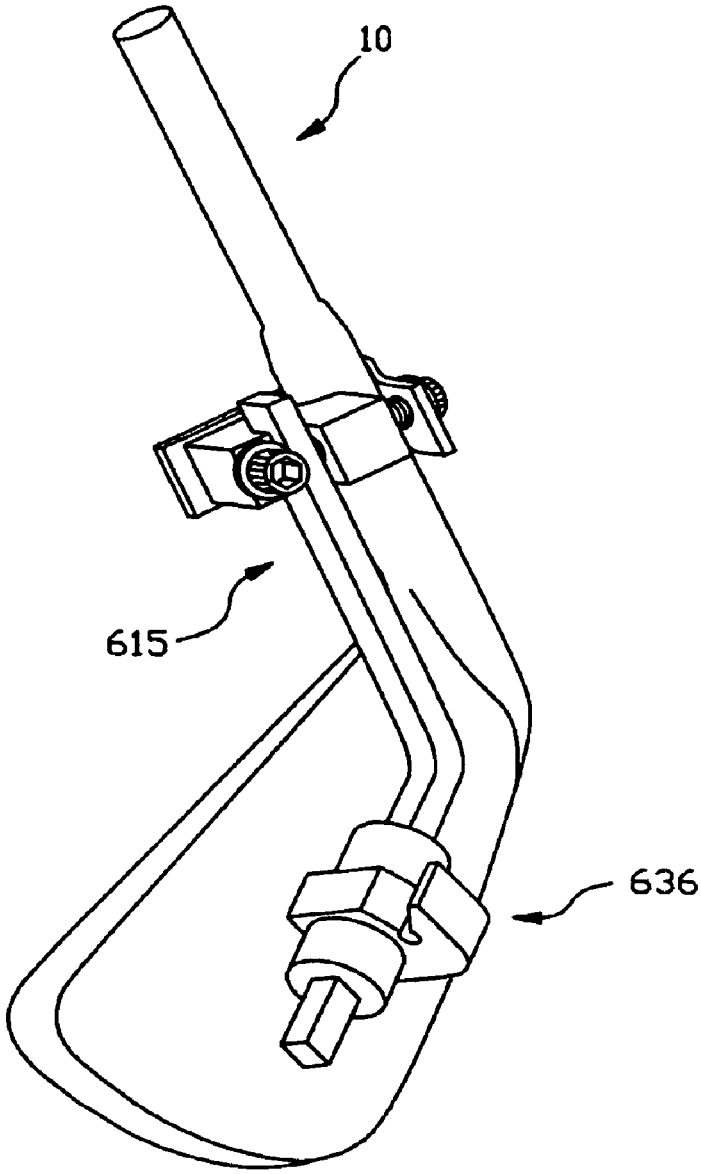
FIG. 44A is a view of a lower portion of the golf club shown in FIG. 44.
Figure 46:
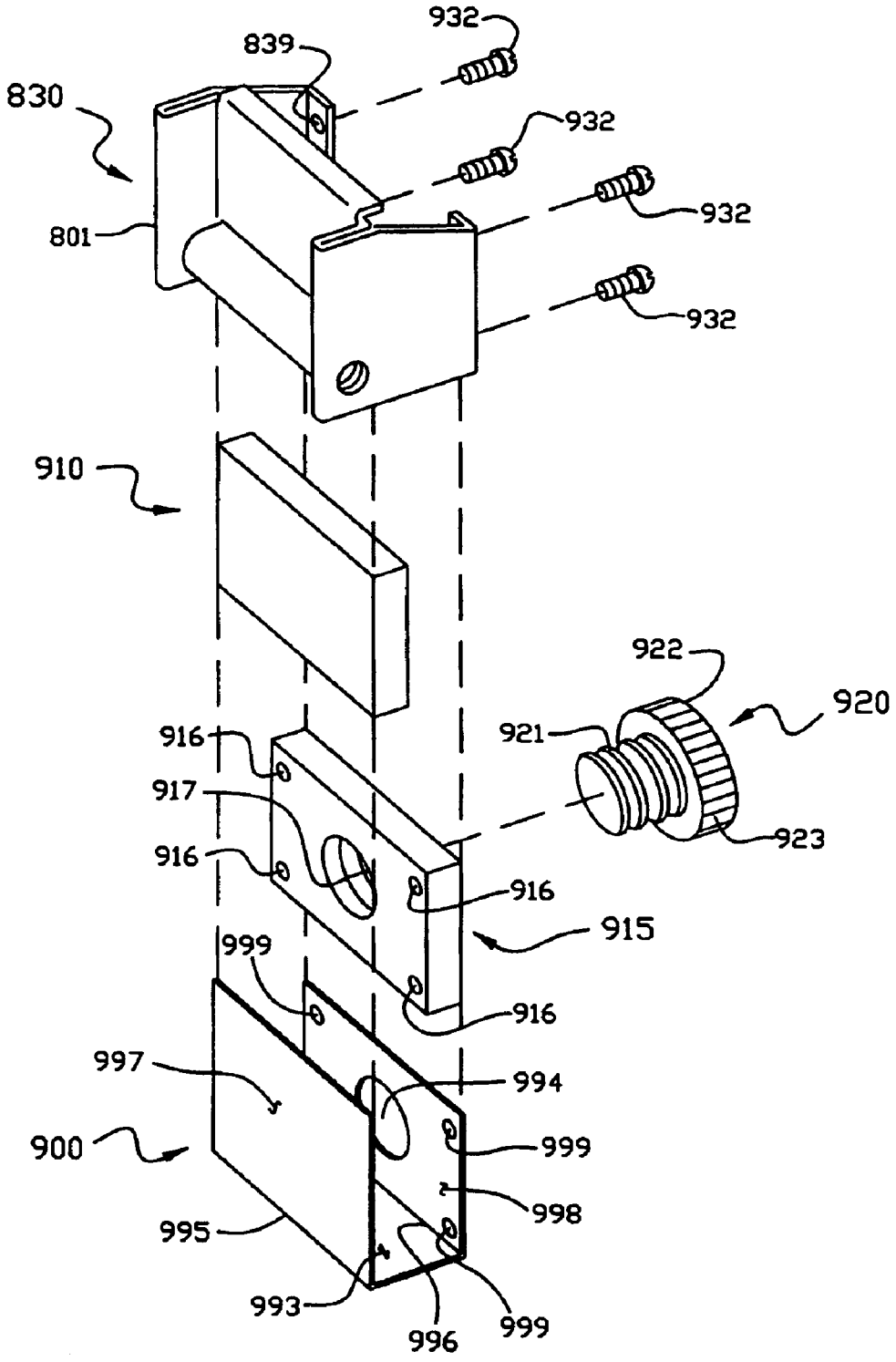
FIG. 46 is an exploded view of a pivot arm assembly having a Frame as shown fabricated in FIGS. 45–45D.
Figure 47:
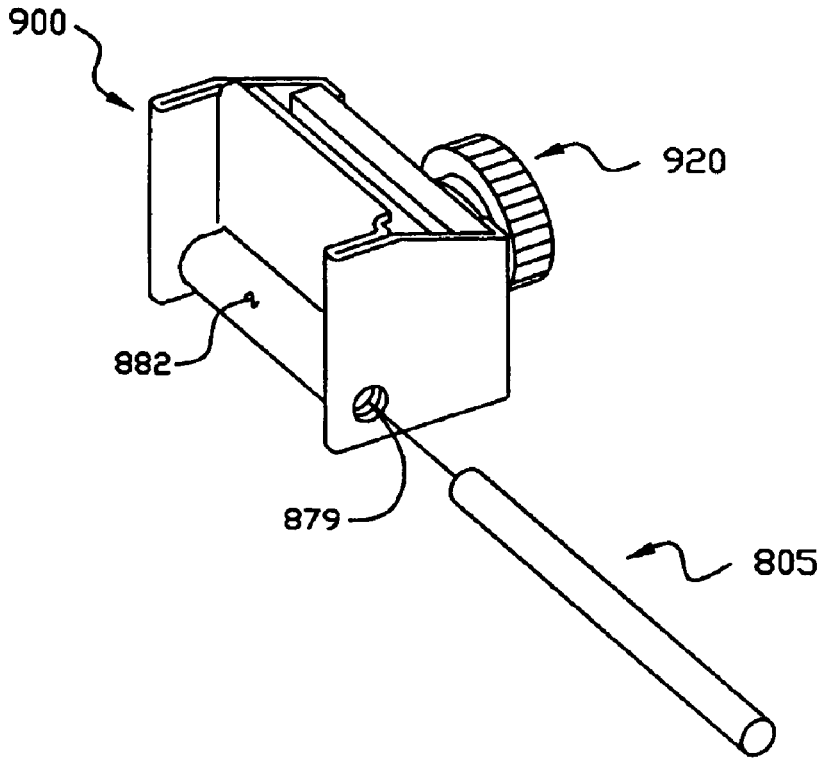
FIGS. 47 and 48 are perspective views of portions of the pivot arm assembly shown in FIG. 46.

Referring to FIG. 44, a metal strap 660 has a bore 661 and a bore 662. The bore 662 receives a screw 663 having thereon a washer 664 and bore 661 receives screw 665. A clamping member 668 has a quarter-bore 651 perpendicular to a top face 652, a front face 653 of which there is an adjacent face 654. A bore 655 and a bore 656 are threaded and have centerlines that are perpendicular to the face 654 and 653, respectively. Beyond a projected intersection of adjacent faces 653 and 654 is a square open-ended slot 656. The hosel 651 of the golf club is captured by the quarter-bore 651 and the metal strap 660 as the clamping member 668 is assembled to the hosel 651 with screw 663 and a nut 667. Positioned within the open-ended square slot 656 is a straight portion 671 of a steel bar 670 having a square cross section. The bar 670 has a plurality of angled bends and straight sections. A first bend 672 and a second bend 673 forms the steel bar 670 such that a straight portion 677 is angled rearward towards a clubface 690 having a rearward offset with respect to its hosel 651. A forth straight portion 678 forms an angle 679 with a third straight portion 680 such that the straight portion 678 runs parallel to the clubface 690 near a bottom leading edge 691. A bar (not shown) could be bent in such a manner to be positioned near a clubface having a forward offset with respect to a hosel. FIG. 44A depicts an assembled view of an alternate embodiment of the present invention having a square rod 15 with a single bend to accommodate clubs not having an offset with respect to its hosel.

Referring to FIG. 45, a formed metal frame 801 of a portion of a target mount pivot arm assembly 830 is provided. The frame 801 is fabricated from a blank 800 cut out of 16-gauge sheet metal stock which is progressively bent. A first ninety-degree bend and a second ninety-degree bend are made at a phantom line 871 and 872. A third and a forth bend is made at a phantom line 874 and 875 and continues 180 degrees to complete a fold of the sheet metal at said lines 874 and 875. A shaded area 860 and 861 represents material that is cut. The cut stops at a phantom line 876. Referring to FIGS. 45A and 45B, a fifth bend is made at a phantom 876, rotating a section 877 ninety degrees outward with respect to a face 873. A bore 878 and 879 (not shown) is machined near a bottom edge 880 and 881. A tool is inserted into the bore 878 and 879 of which the flat section 877 is formed around to create a cylindrical bearing 882 (see FIGS. 45C and 45D). Finally, ninety-degree bends are made at a phantom line 883, 884 and 885 to complete the metal frame of the pivot arm assembly 830. The bend 883 and 884 forms a short face 886 and 887 both of which have a pair of upper bores 839 and a pair of lower bores 837 (also shown is FIG. 48).

Figure 48:
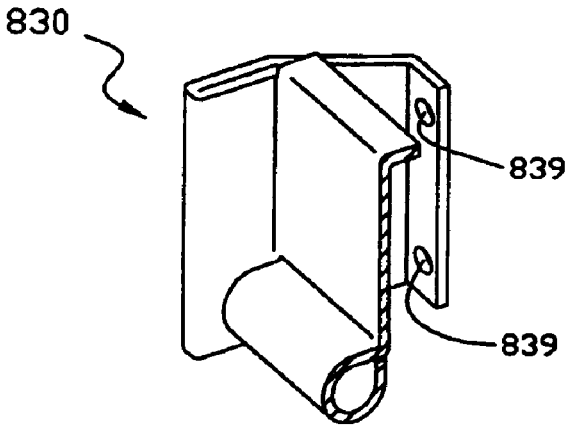

Referring to FIGS. 46–48A, a U-shaped member 900 is formed out of 18-gauge sheet metal having a first 995 and a second 996 bend forming a face 997 and a face 998 that are parallel to one another and perpendicular with a bottom face 993. A first face 997 receives a rubber pad 910. A second face 998 has a plurality of bores 999 near each of its four corners. A bore 994 has its center located at an intersection of the diagonals of face 998. The second face 998 receives a plastic rectangular plate 915. The plate 915 has a plurality of threaded bores 916 having centers that are coincident with bores 999 of face 998. Likewise the center of a bore 917 of plate 915 is coincident with the center of bore 994 of face 998. The bore 917 is threaded to receive a clamping screw 920. The clamping screw 920 has at one extreme end a threaded section 921 and a head 922 at another extreme end. The head 922 of the clamping screw member has a larger diameter than the diameter of the threaded portion. A surface 923 of the head 922 has a knurl groove pattern. The groove length is equal to the head thickness and continues 360-degrees around the circumference of the surface 923. The U-shaped member 900 (FIG. 47) is assembled with a plurality of screw fasteners 932 to the plate 915 and the metal frame. The assembly is completed after a pivot shaft 805 is inserted through bore 879, bearing 882 and finally bore 878 of the frame 801. FIG. 48 B illustrates the pivot arm assembly with its target holder being positioned on a swing platform 1850

Figure 48A:
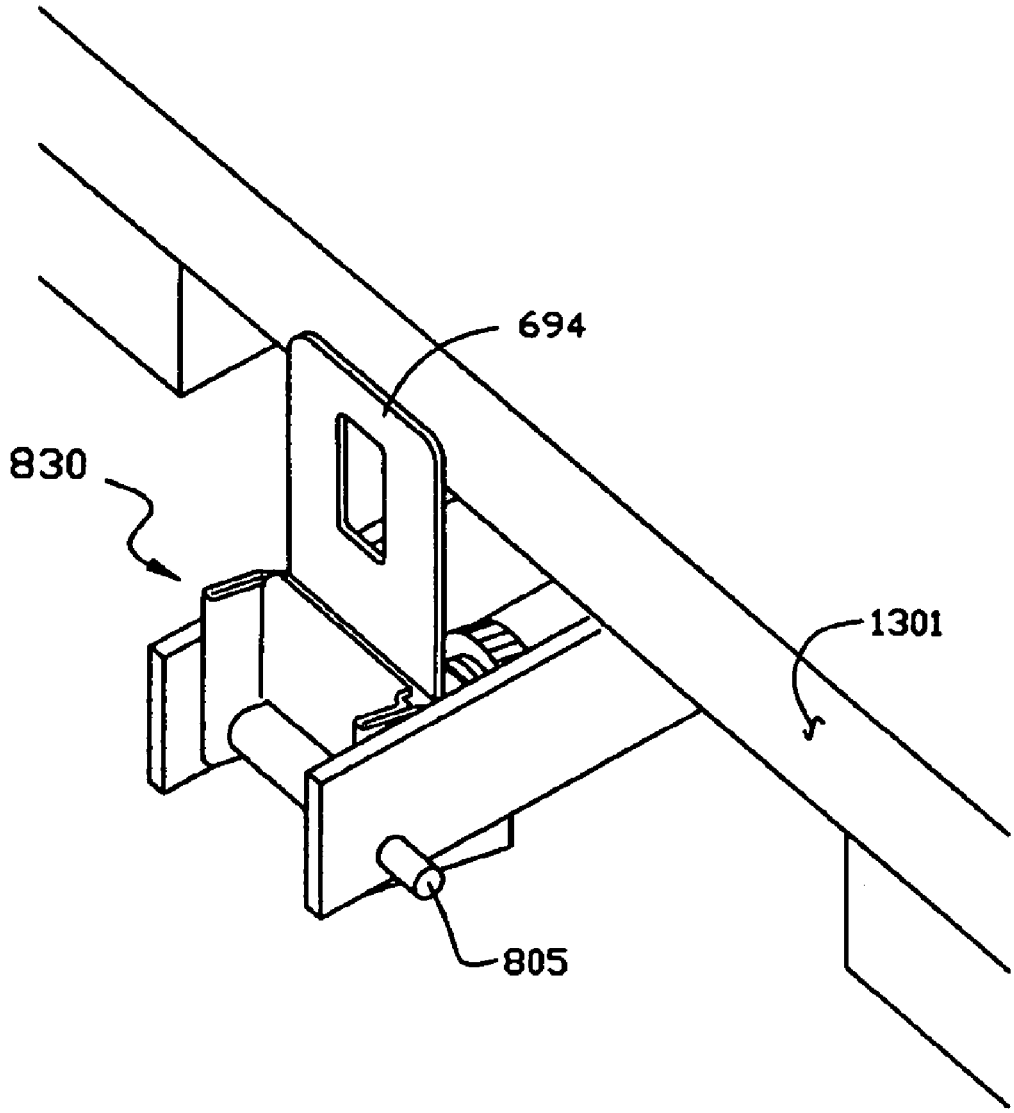
FIG. 48A is a perspective view of a pivot arm assembly as shown in FIG. 46 connected on a swing platform.
Figure 50:
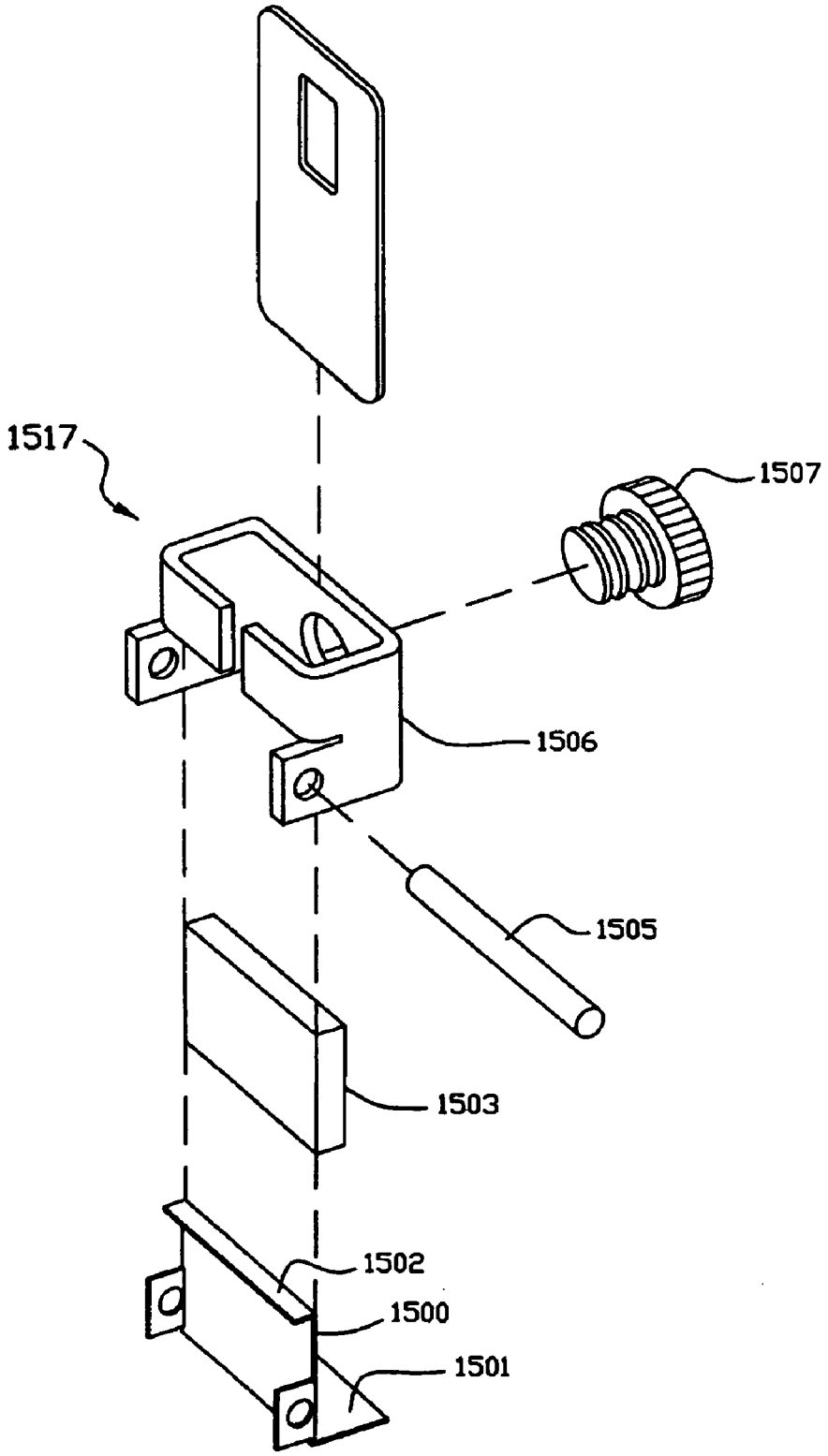
FIG. 50 is an exploded view similar to FIG. 46 of an alternate preferred embodiment pivot arm assembly.
Figure 51:
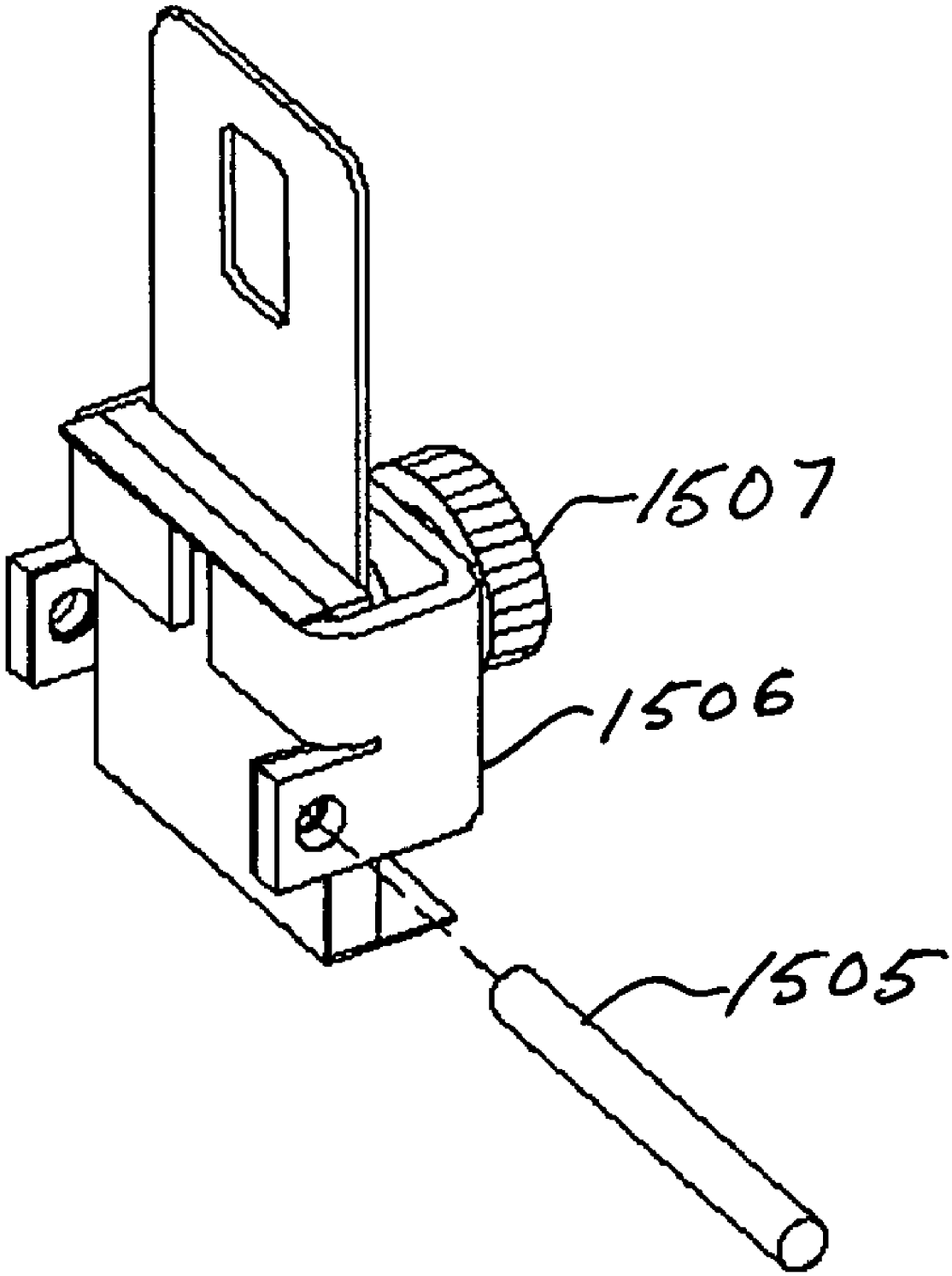
FIG. 51 is an assembled view of the pivot arm assembly shown in FIG. 50.
Figure 51A:
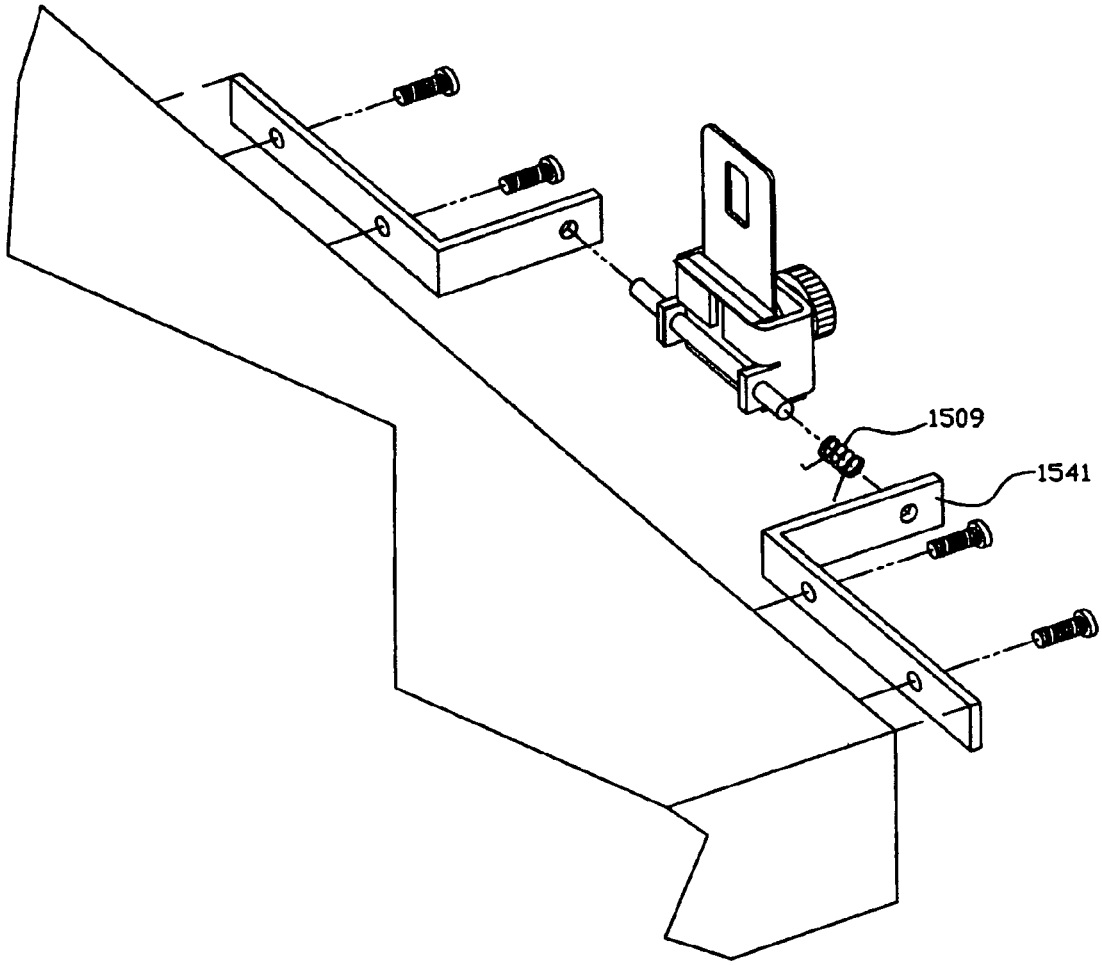
FIG. 51A is a view similar to FIG. 48 a pivot arm assembly of FIG. 50 shown connected with a swing platform.

Referring to FIGS. 50–51A an alternative mount having a pivot arm and target holder 1517 is provided having a main body formed from stamping 1506. The stamping 1506 has a threaded bore to receive the screw 1507. The stamping 1506 is pivotally supported from a swing platform brackets 1541 by a shaft 1505 that also structurally supports plate 1500 having flanges 1501 and 1502. An advantage of the pivot arm assembly 1517 is that it is cantileverly supported so that it can completely turn on the shaft 1505 with out contacting a surface that the swing platform is placed on. Side springs 1509 keep the stamping 1506 from flopping over. Additionally the clamping screw knob is facing toward the front instead or the rear as is the case with the prior described clamping screw 920 (FIG. 48A). A pad 1503 functions in a manner as previously described.

Figure 49:
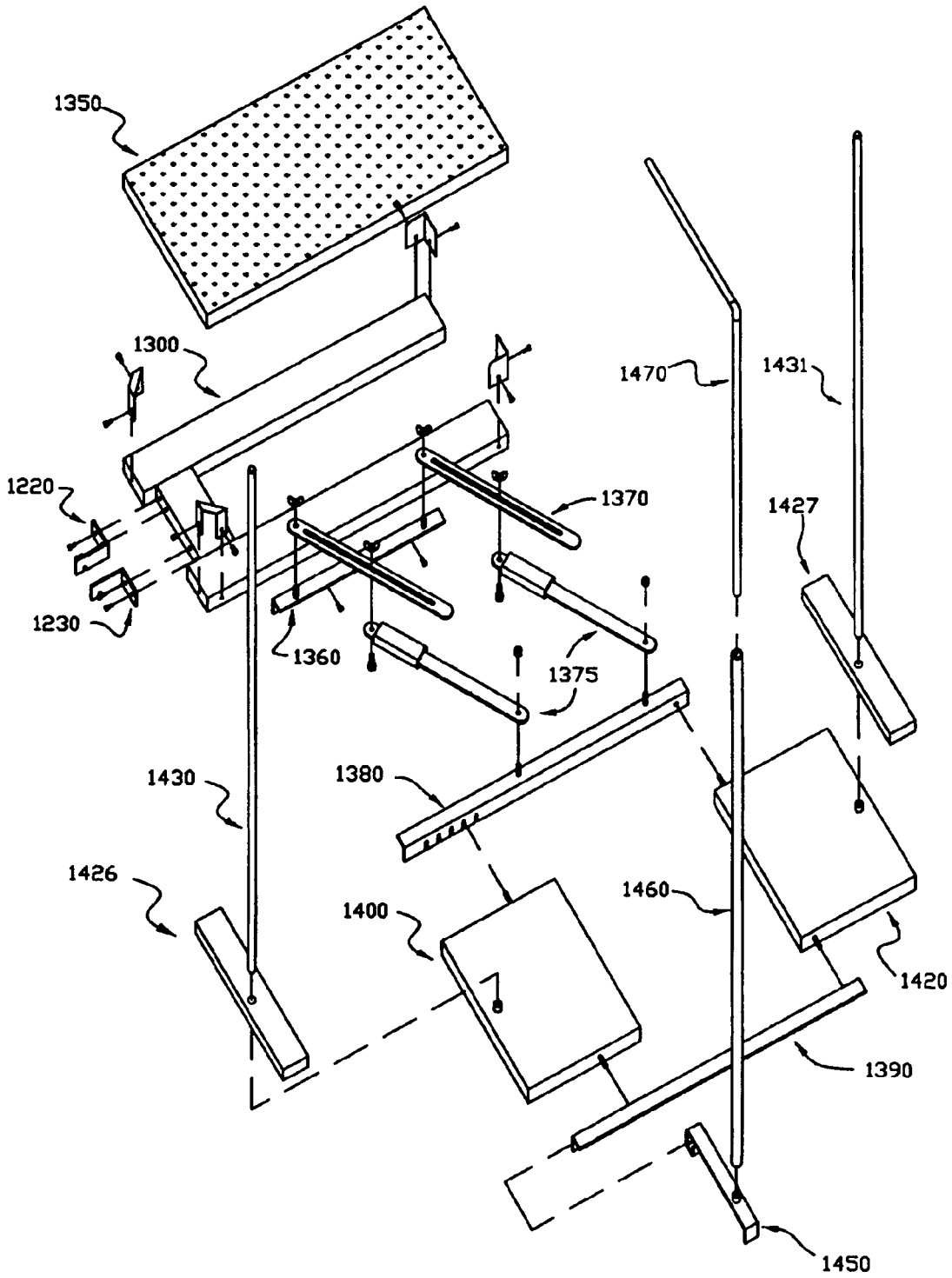
FIG. 49 is an exploded view of a combination swing platform used with a golf club of the present invention.
Figure 49A:
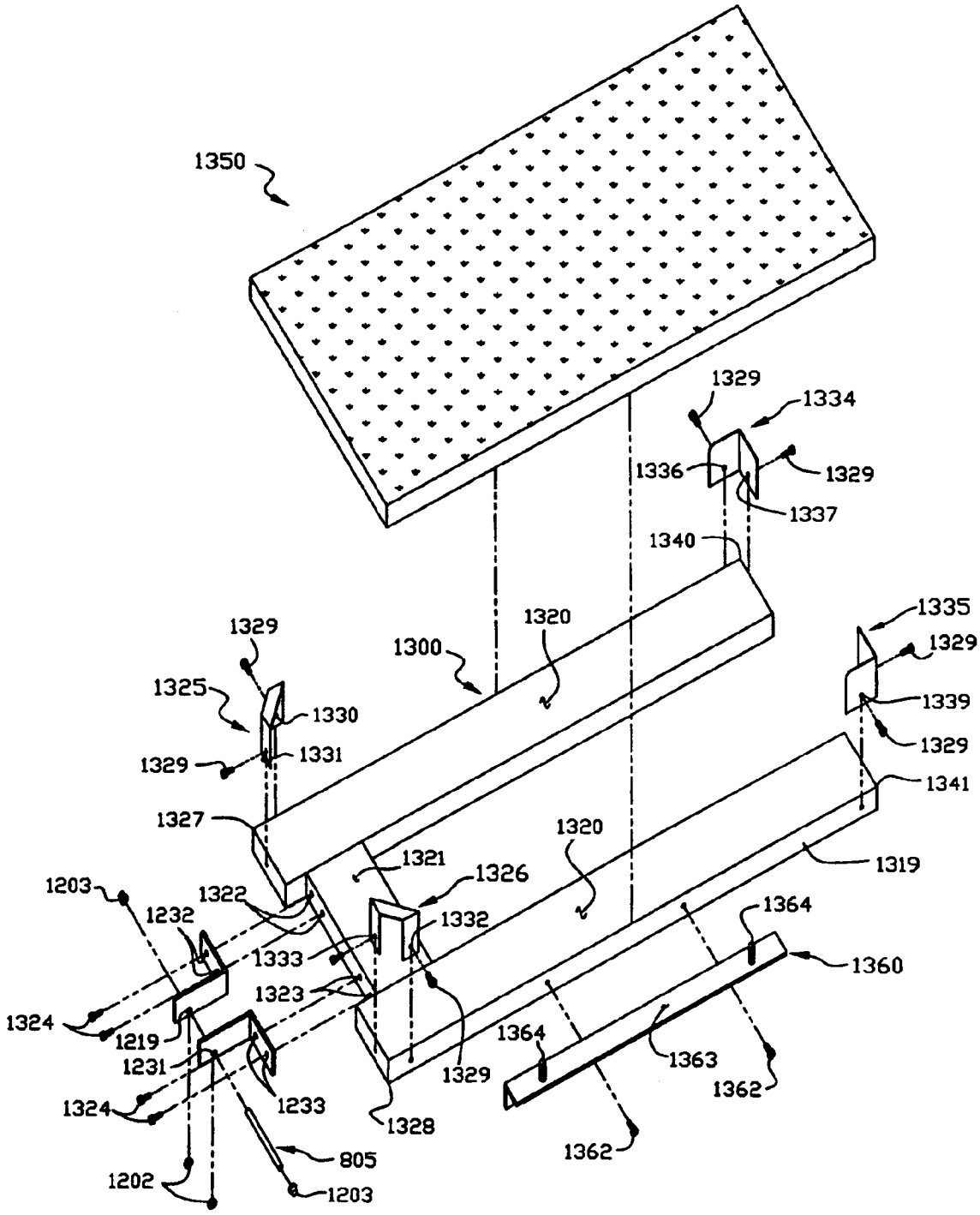
FIGS. 49A–49C are exploded views of portions of the combination swing platform assembly shown in FIG. 49.

Referring to FIGS. 49 and 49A, the shaft 805 extreme ends are received by a bore 1231 in a right hand support bracket 1230 and a bore 1219 in a left hand support bracket 1220. The pivot arm assemble 830 is located mid span of the pivot shaft 1205 between the left and right hand support brackets. A pair of spacer washers 1202 is used to center the pivot arm assembly 830 between the support brackets. The pivot arm assembly 830 is then free to rotate about the left and right hand support bracket bores 1219 and 1220. A fastener 1203 is pressed onto the extreme ends of the shaft 805, which constrains the shaft from lateral movement.

Referring to FIG. 49A, an exploded view of an adjustable golf swing platform is depicted. A base frame 1300 having members 1320 that are parallel to each other and joined together by a cross member 1321. The cross member 1321 has a set of through bores 1322 and a set 1323 at its extreme ends. In the embodiment of the present invention the base frame 1300 is made of wood. The left hand support bracket 1220 and the right hand support bracket 1230 have a set of bores 1232 and 1233; respectively, the centers of which are coincident with the bores in cross member 1321. A plurality of screw fasteners 1324 are used to secure the support brackets to the cross member. A left-hand front strap 1325 and a right-hand front strap 1326 are fastened to a corner 1327 and 1328; respectively, with a screw fastener 1329 passed through a bore 1330 and 1331 and a bore 1332 and 1333 of said straps 1325 and 1326. A left-hand rear end-stop 1334 having a bore 1336 and 1337 and a right-hand rear end-stop 1335 having a bore 1338 and 1339 is similarly attached to a rear corner 1340 and 1341; respectively, using screw fastener 1329. A turf matt 1350 is positioned on the base frame having its front corners captured underneath the left-hand and right-hand front straps 1325 and 1326. The rear corners of turf matt 1350 butts up against the end-stops 1334 and 1335. A bracket 1360 has a vertical side of which a pair of bores 1361 (not shown) receives screw fasteners 1362 to attach said bracket 1360 to a side 1319 of frame member 1320. A horizontal side 1363 of bracket 1360 has a pair of threaded studs 1364 that project upward at a ninety-degree angle.

Figure 49B:
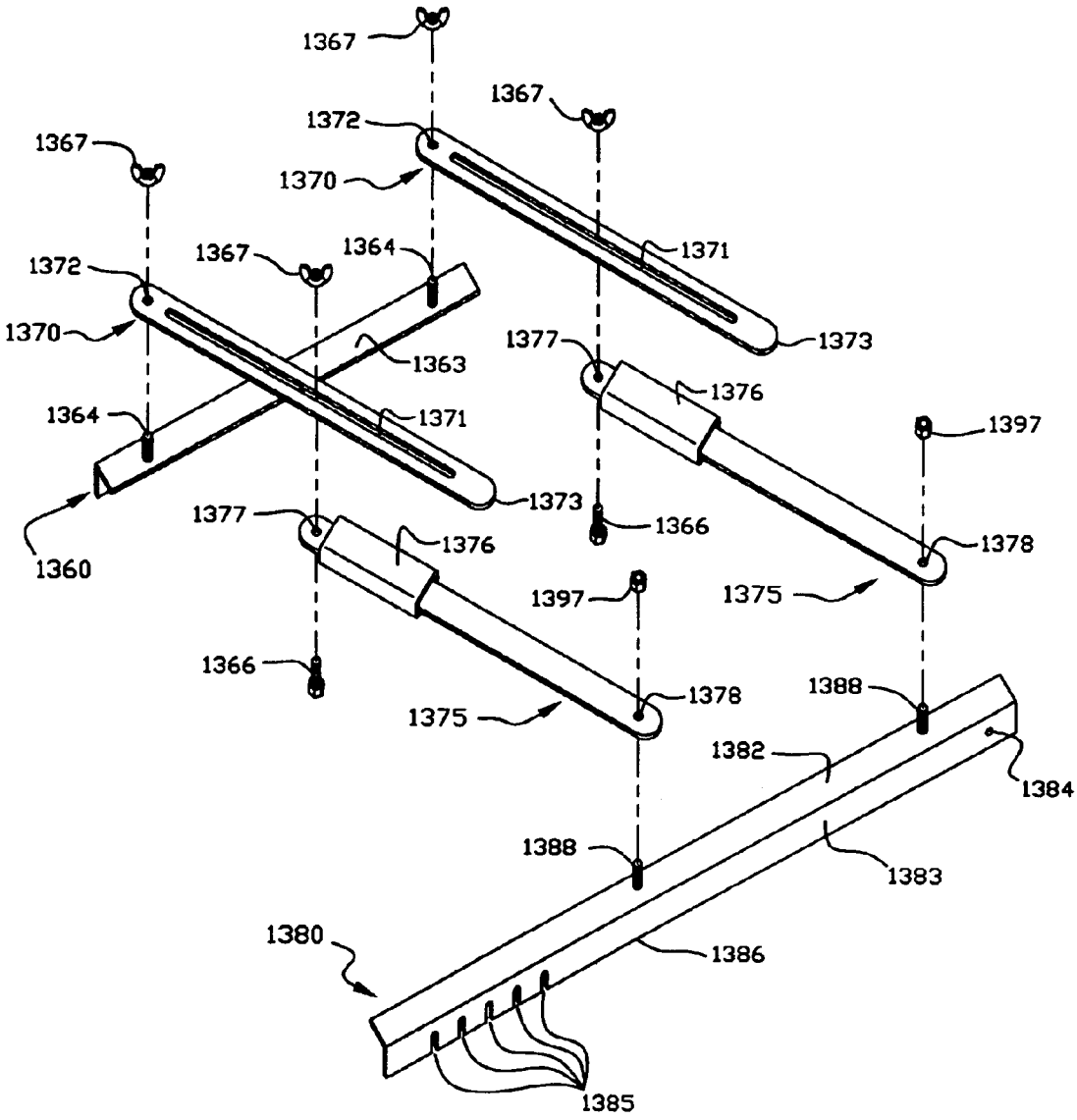

Referring to FIG. 49B, a first pair of link members 1370 has a longitudinal slot 1371 and a bore 1372 at one of its extreme ends. A second pair of link members 1375 has a channel 1376 and a bore 1377 and a bore 1378 at its extreme ends. Upon assembly an extreme end 1373 of the link member 1370 is inserted in the channel 1376. A screw fastener 1366 is passed through bore 1377 and the slot 1371. A wing nut 1367 is used to adjustably tighten the linkage assemble. A bracket 1380 has a pair of threaded studs 1388 on a horizontal side 1382. The threaded stud 1388 receives the bore 1376 after which a nut 1397 is use to tighten the assembly. On a vertical side 1383 of the bracket 1380 is a bore 1384 at one extreme end and a plurality of slots 1385 at the other extreme end. The slots are open at an edge 1386 of the bracket. The link members 1370, 1375 form a linkage assembly 1800 in a quadrangular or parallel manner pivotally connect a platform which supports the feet of a golfer with another platform which supports a golf ball, practice golf ball, or target.

Figure 49C:
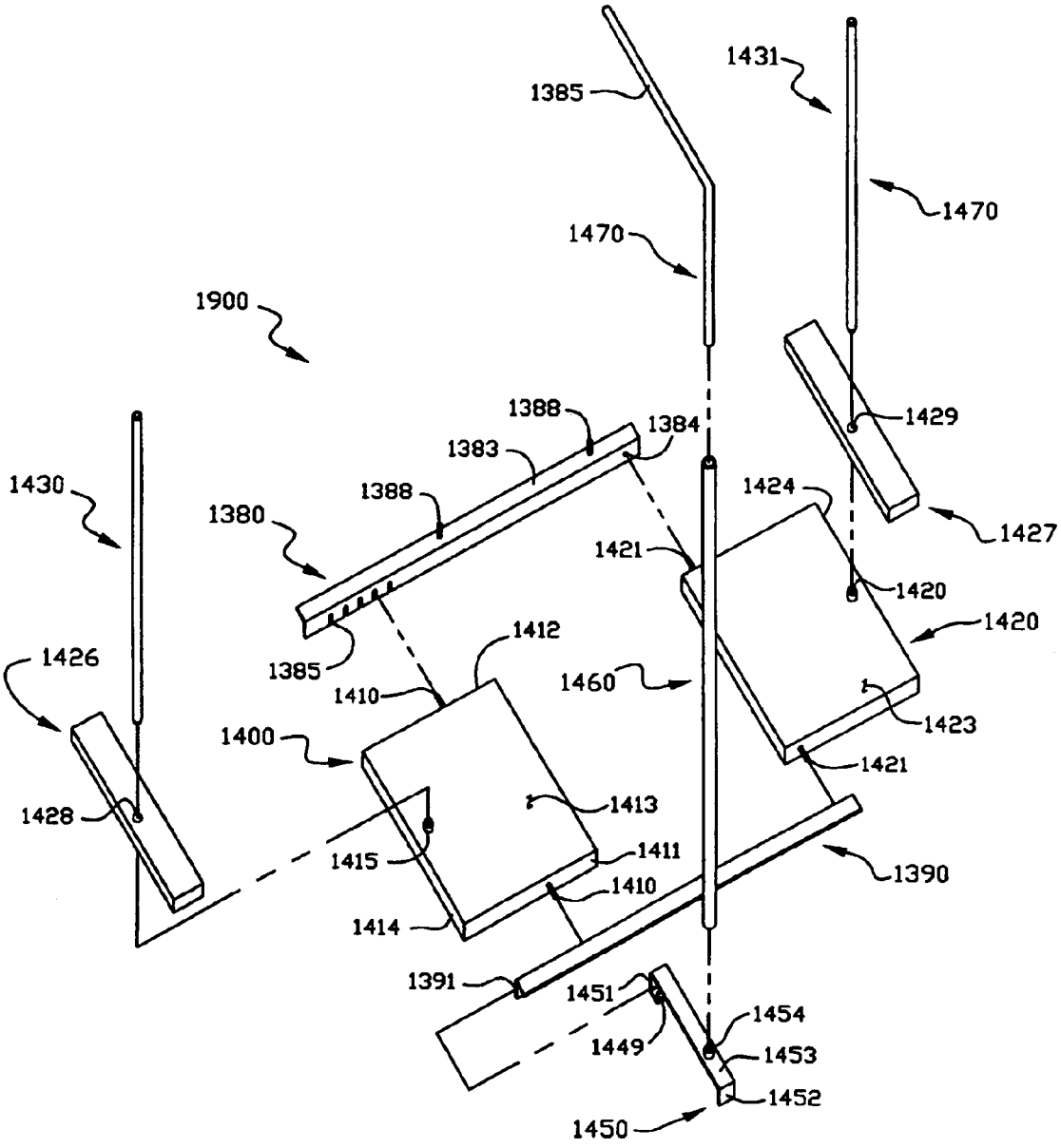

Referring to FIG. 49C, a bracket 1390 has a vertical side 1391 that has at one extreme end slots (not shown) having concentric centers with the slots of bracket 1380. A bore (not shown) at the other extreme end of the vertical side 1391 is coincident with the bore 1384 in the vertical side 1383. A left-foot pad 1400 is show having a pair of studs 1410. The studs project from a side 1411 and 1412 and have common centers. Projecting from a top face 1413 near an outside edge 1414 is a dowel 1415. A right-foot pad 1420 similarly has a pair of studs 1421 with common centers and a dowel 1422 that project from a top face 1423 near an outside edge 1424. A left footrest 1426 and a right footrest 1427 have a bore 1428 and a bore 1429, respectively. The bore 1428 receives the dowel 1415 of the left-foot pad 1400. Likewise, the bore 1429 receives dowel 1422 of the right-foot pad 1420. The thickness of the footpad is sufficient such that bore 1428 and 1429 are deep enough to receive and support a post or dowel rod 1430 and a dowel rod 1431 vertically upright. A sliding arm or bracket 1450 is formed with a hook 1451 at one extreme end and a face 1452 at an opposite end. The face 1452 points downward and makes a ninety-degree angle with a horizontal face 1453. Located near a bend between the face 1453 and the face 1452 and projecting from the face 1453 is a dowel 1454. The dowel 1454 supports a post or tube 1460, which has an internal diameter that is sized to fit tightly around the outer diameter of the dowel 1454. The hook 1451 has a feature 1449 that allows the bracket 1450 to be supported horizontally on the bracket 1390. The bracket 1450 can be moved freely about the longitudinal axis of bracket 1390. Finally, a dowel rod 1470 is adjustably positioned within the tube 1460. The dowel rod 1470 has a ninety-degree bend forming a straight portion 1472. The straight portion 1472 is normally positioned parallel to the ground or floor upon which the foot pads rests.

Figure 49D:
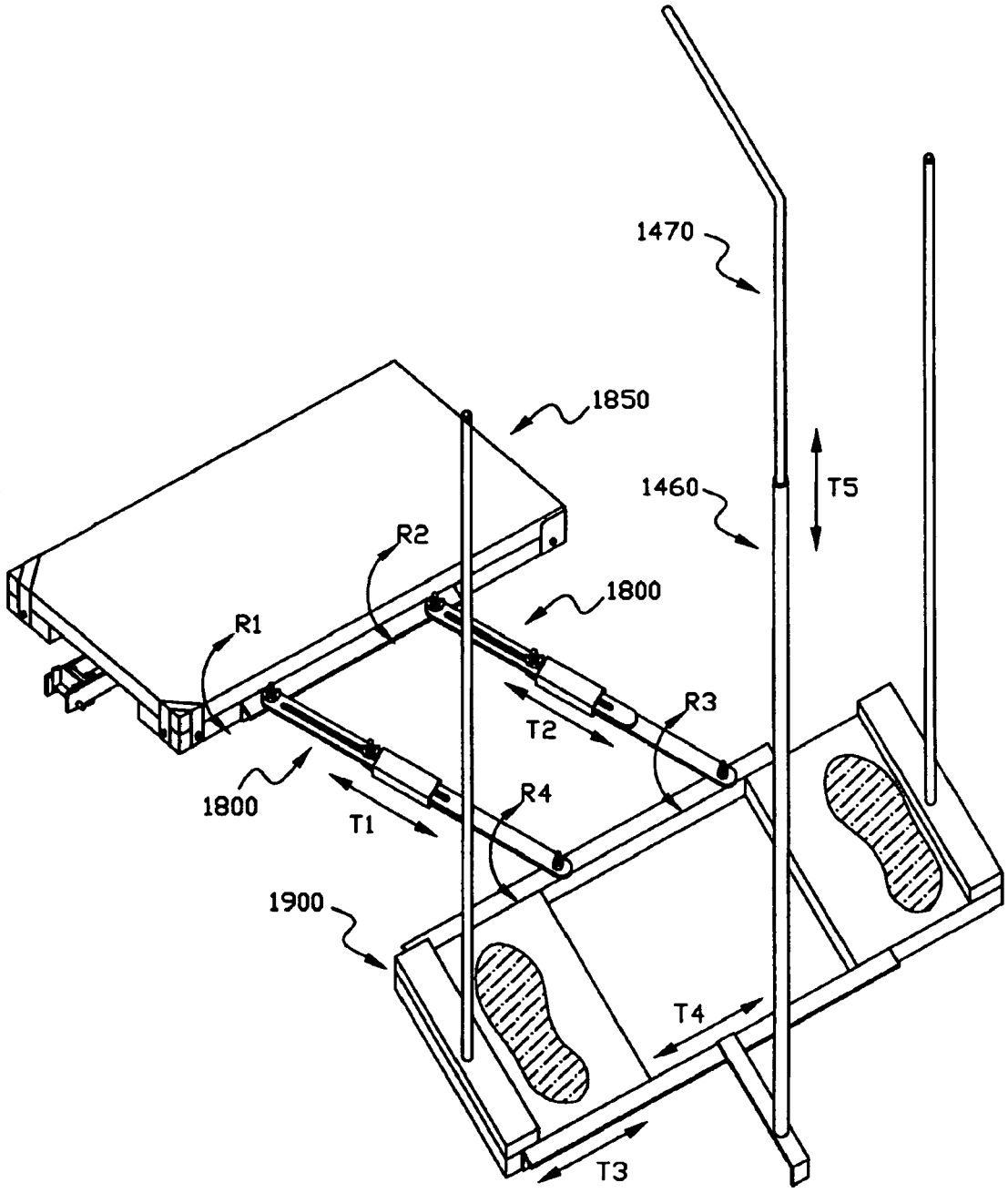

Referring to FIG. 49D is an assembled view of an adjustable golf swing combination platform assembly 1700 having a linkage assembly 1800. The golf swing platform combination assembly 1700 has multiple degrees-of-freedom for adjustments. A degree-of-freedom T1 and T2 allow links 1370 and 1375 to slide with respect to one another along their longitudinal axis. Another degree-of-freedom R1 and R2 allow the swing platform 1850 which mounts the pivot arm assembly 830 (FIG. 49B) to rotate about studs 1364. At the other end of the linkage assembly 1800 a left and right-foot pad assembly 1900 is free to rotate about studs 1388. A degree-of freedom T3 represents an adjustment of the left-foot pad to increase or decrease its distance between the right-foot pad. A degree-or freedom T4 allow for an adjustment of the horizontal position of the tube 1460 while T5 allow for a vertical adjustment of the height of dowel rod 1470 within the tube and relative to the ground or floor.

The left-foot rest 1426 and the right-foot rest 1427 are used to support the outside edge of a user's left and right foot, respectively. The dowel rods 1430 and 1431 extend an average height of three feet from their foot rests. The following use description of the present invention is for a right-handed golfer and the opposite would be expected of a left-handed golfer. The dowel rod 1431 extending vertically upward from the right-foot rest 1426 establishes a right-side boundary of which a user's right leg, hip and upper body should not cross when moving laterally toward said post during a proper take-away of a golf club from its target address position to a position over the user's right shoulder as the user turns the upper body to completed the back swing. Similarly, the dowel rod 1430 extending from the left-foot rest 1426 establishes a boundary that a user's left leg should not cross during weight transfer of the from the right foot over to the left foot, as the club is swung downward from the top of the back swing then through impact of the target and finally brought over the left shoulder to a finish position. The post 1460 attached to bracket 1450 is positioned behind the user and extends vertically upwards having a height that can be adjusted such that a horizontal member or straight portion 1472 connected to the upper end of said post extends over the left shoulder of a right-handed user and over the right shoulder of a left-handed user. The straight portion 1472 defines a boundary of which a user's head should not cross during the down swing and follow through of the golf swing.

The present invention has been shown in various embodiments. However, it will be apparent to those skilled in the art of the various modifications that can be made to the present invention without departing from the spirit or scope of the invention as it is encompassed by the following claims.

The invention claimed is:

1. An apparatus to simulate a proper hitting of a golf ball by a golf club, said apparatus comprising:

a golf club having a shaft with a head connected on an extreme end thereof, said golf club further including a latch member connected adjacent to said head, said latch member having a hook portion and a target contact portion lateral to said hook portion;

a target with an aperture for receipt of said latch member hook portion to allow for connection with said latch member and having a surface for contact with said latch member contact portion when said hook portion is received into said target aperture; and a mount holding said target wherein when said golf club is swung in a predetermined manner, said target is released from said mount and connected with said latch member, and wherein when said golf club is swung in a non predetermined manner, said golf club contacts said target to cause said target to pivot downward while being retained by said mount.

2. An apparatus as described in claim 1 wherein said latch member has a second contact portion generally lateral of said hook portion.

3. An apparatus as described in claim 1 wherein said latch member hook portion has an upper surface with a major notch intersecting an upper surface.

4. An apparatus as described in claim 3 wherein said latch member hook portion major notch is V shaped and angled between 70–85 degrees.

5. An apparatus as described in claim 1 wherein said latch member contact portion is generally curvilinear.

6. An apparatus as described in claim 1 wherein said latch member contact portion is generally curvilinear and wherein said latch member hook portion has an upper surface with a major notch intersecting an upper surface with an intersecting sub notch and said sub notch has a surface projecting generally tangent to said contact portion.

7. An apparatus as described in claim 6 wherein a centerline of said sub notch is generally above and forward of a centerline of said latch member contact portion when said latch member hook portion penetrates said aperture of said target.

8. An apparatus to simulate a proper hitting of a golf ball by a golf club, said apparatus comprising:

a golf club having a shaft with a head connected on an extreme end thereof, said golf club further including a latch member connected adjacent to said head, said latch member having a hook portion, said hook portion having a major notch and said major notch being intersected by a subnotch having a gap;

a target with an aperture for receipt of said latch member hook portion, said target having a thickness adjacent said aperture having an interference fit with said minor notch gap; and a mount holding said target wherein when said golf club is swung in a predetermined manner, said target is released from said mount and connected with said latch member, and wherein when said golf club is swung in a non predetermined manner, said golf club contacts said target to cause said target to pivot downward while being retained by said mount.

9. An apparatus as described in claim 8 wherein said latch hook portion sub notch has a gap generally 60–90% of a thickness of said target.

10. An apparatus as described in claim 8 wherein said latch member hook portion includes an expert tab to contact said target to move said target so that said latch member hook portion can not connect with said target when said golf club is not swung within a predefined expert level of squareness.

11. An apparatus as described in claim 10 wherein said expert tab can be placed on said latch member on opposite sides of said latch member hook portion.

12. An apparatus as described in claim 10 wherein said expert tab is pivotal with said latch member.

13. An apparatus as described in claim 8 wherein said target aperture has a shape matching a cross section of said latch hook portion.

14. An apparatus as described in claim 13 wherein said target aperture is generally polygonal in shape.

15. An apparatus as described in claim 8 wherein a portion of said mount holding said target has two surfaces providing a slot therebetween, one of said surfaces being able to move with respect to said other surface by rotation of a threaded member.

16. An apparatus as described in claim 8 wherein said golf club has a head with a face offset forward from said shaft of said club and said latch member hook portion is connected to said shaft of said golf club by a hook shaft connected to said golf club shaft and said hook shaft having an angled portion to accommodate said offset of said golf club face.

17. An apparatus as described in claim 8 wherein said mount has a practice surface adjacent thereto and wherein a portion of said mount holding said target can pivot without contacting a lower surface said practice surface is placed on.

18. An apparatus as described in claim 8 wherein said apparatus further includes a first platform for supporting the feet of a golf practitioner and a second platform quadrangularly pivotally connected to said first platform, said first platform being connected with a portion of said mount holding said target.

19. An apparatus to simulate a proper hitting of a golf ball by a golf club, said apparatus comprising:

a golf club having a shaft with a head connected on an extreme end thereof, said golf club further including a latch member connected adjacent to said head, said latch member having a hook portion;

a target with an aperture for receipt of said latch member hook portion to allow for connection with said latch member and having a surface for contact with said latch member contact portion when said hook portion is received into said target aperture;

a mount holding said target wherein when said golf club is swung in a predetermined manner, said target is released from said mount and connected with said latch member, and wherein when said golf club is swung in a non predetermined manner, said golf club contacts said target to cause said target to pivot downward while being retained by said mount; and wherein said latch member hook portion further includes an expert tab to contact said target to move said target so that said latch member hook portion can not connect with said target when said golf club is not swung within a predefined expert level of squareness.

* * * * *